US010569557B2

(12) United States Patent
Hayashi et al.

(10) Patent No.: US 10,569,557 B2
(45) Date of Patent: Feb. 25, 2020

(54) INKJET RECORDING APPARATUS INCLUDING INK CARTRIDGE PROVIDED WITH FIRST VALVE AND CARTRIDGE-ATTACHMENT PORTION PROVIDED WITH SECOND VALVE

(71) Applicant: BROTHER KOGYO KABUSHIKI KAISHA, Nagoya-shi, Aichi-ken (JP)

(72) Inventors: Masahiro Hayashi, Nagoya (JP); Akinari Ishibe, Okazaki (JP); Yoshinori Osakabe, Seto (JP); Akihito Ono, Nagoya (JP); Hiroaki Takahashi, Nagoya (JP); Akihito Kobayashi, Konan (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/124,452

(22) Filed: Sep. 7, 2018

(65) Prior Publication Data

US 2019/0077159 A1 Mar. 14, 2019

(30) Foreign Application Priority Data

Sep. 8, 2017 (JP) ..... 2017-172822

(51) Int. Cl.
*B41J 2/175* (2006.01)
*B41J 29/13* (2006.01)

(52) U.S. Cl.
CPC ..... *B41J 2/1752* (2013.01); *B41J 2/17509* (2013.01); *B41J 2/17513* (2013.01);
(Continued)

(58) Field of Classification Search
CPC .. B41J 2/1752; B41J 2/17553; B41J 2/17503; B41J 2/17509; B41J 2/17513; B41J 2/1754; B41J 2/17533; B41J 2/17523
See application file for complete search history.

(56) References Cited

U.S. PATENT DOCUMENTS 6,543,886 B1 * 4/2003 Hattori et al. ..... B41J 2/1752
2007/0176987 A1 8/2007 Tanahashi et al.
(Continued)

FOREIGN PATENT DOCUMENTS

JP 2007-175998 A 7/2007
JP 2010-012677 A 1/2010

*Primary Examiner* — Juanita D Jackson
(74) *Attorney, Agent, or Firm* — Merchant & Gould P.C.

(57) ABSTRACT

An inkjet recording apparatus includes a cartridge-attachment portion and an ink cartridge attachable thereto. The ink cartridge includes: a main body formed with an opening; an ink chamber disposed in the main body; a first valve opening and closing the opening; and a first pressing surface. The cartridge-attachment portion includes: an ink supply member providing an ink passage formed with an inlet; a second valve opening and closing the inlet; and a second pressing surface. In the attachment process, the ink supply member enters the ink chamber through the opening, the first pressing surface moves the second valve to a position opening the inlet, and the second pressing surface moves the first valve to a position opening the opening. In an attached state, the inlet is opened and positioned in the ink chamber, and the ink passage is in communication with the ink chamber through the inlet.

8 Claims, 14 Drawing Sheets

(52) U.S. Cl.
CPC ..... *B41J 2/17523* (2013.01); *B41J 2/17553* (2013.01); *B41J 29/13* (2013.01)

(56) References Cited

U.S. PATENT DOCUMENTS

| | | | | |
|---|---|---|---|---|
| 2010/0002061 | A1 | 1/2010 | Shibano | |
| 2011/0096127 | A1* | 4/2011 | Ishibe et al. ..... | B41J 2/17513 |
| 2016/0368272 | A1* | 12/2016 | Ono et al. ..... | B41J 2/1752 |

* cited by examiner

INKJET RECORDING APPARATUS INCLUDING INK CARTRIDGE PROVIDED WITH FIRST VALVE AND CARTRIDGE-ATTACHMENT PORTION PROVIDED WITH SECOND VALVE

CROSS REFERENCE TO RELATED APPLICATION

This application claims priority from Japanese Patent Application No. 2017-172822 filed Sep. 8, 2017. The entire content of the priority applications is incorporated herein by reference.

TECHNICAL FIELD

The present disclosure relates to an inkjet recording apparatus including an attachment portion and an ink cartridge attachable thereto.

BACKGROUND

In recent years, an inkjet recording apparatus that employs an inkjet recording head has been widely known as an image recording apparatus that records images on sheets in a simple and a cost-effective manner. The inkjet recording apparatus is provided with an ink supplying device for supplying ink to the recording head.

The ink supplying device includes a cartridge-attachment portion and ink cartridges detachably attachable thereto. Through the cartridge-attachment portion, ink in each of the ink cartridges is supplied to the recording head.

Each of the ink cartridges and the cartridge-attachment portion is provided with an ink passage and a valve configured to open and close the ink passage for preventing leakage of ink from the ink passage to the outside and mixing of air into the ink passage.

When the ink cartridge 50 has not been attached to the cartridge-attachment portion, the valve of the ink cartridge and the valve of the cartridge-attachment portion close the ink passage of the ink cartridge and the ink passage of the cartridge-attachment portion, respectively. On the other hand, when the ink cartridge is attached to the cartridge-attachment portion, the valve of the ink cartridge and the valve of the cartridge-attachment portion move to open the ink passage of the ink cartridge and the ink passage of the cartridge-attachment portion, respectively, thereby causing the two ink passages to be communicated with each other. As a result, ink is supplied from the ink cartridges to the recording head via the cartridge-attachment portion.

For example, in an ink supplying device disclosed in Japanese Application Publication No. 2007-175998, an ink supplying tube provided in a cartridge holder is inserted into the ink cartridge in an attachment process thereof. At this time, a valve body of the ink cartridge and a valve body of the ink supplying tube push each other, thereby causing an ink passage formed in the ink cartridge and an ink inlet formed at the cartridge holder to be opened and communicated with each other. As a result, ink is supplied from the ink cartridge to a recording head.

The valve body of the ink cartridge is urged by an urging member in a direction closing the ink passage. Also, the valve body of the ink supplying tube is urged by an urging member in a direction closing the ink inlet. Further, an urging force of the urging member urging the valve body of the ink supplying tube is smaller than an urging force of the urging member urging the valve body of the ink cartridge.

With the configuration, in the attachment process, the valve body of the ink cartridge and the valve body of the ink supplying tube push each other and thus the valve body of the ink supplying tube first opens the ink inlet.

SUMMARY

In the configuration disclosed in Japanese Application Publication No. 2007-175998, however, an opening order of the ink passage of the ink cartridge and the ink inlet of the cartridge holder is controlled based on the urging forces of the urging members urging the valve bodies. In this case, when the urging forces of the urging members are changed due to, for example, aging degradation, the control to the opening order of the ink passage and the ink inlet may become unstable.

In view of the foregoing, it is an object of the present disclosure to provide an inkjet recording apparatus capable of stably controlling an opening order of an ink passage of a cartridge-attachment portion and an ink passage of an ink cartridge attachable to the cartridge-attachment portion.

In order to attain the above and other objects, according to one aspect, the present disclosure provides an inkjet recording apparatus including a recording head configured to eject ink, an ink cartridge configured to supply ink to the recording head, and a cartridge-attachment portion to which the ink cartridge is detachably attachable. The ink cartridge is inserted into the cartridge-attachment portion in a first direction in an attachment process of attaching of the ink cartridge to the cartridge-attachment portion. The ink cartridge includes a main body, an ink chamber, a first valve, a first urging member, a first contact surface, and a first pressing member. The main body is formed with an opening opening to an outside of the ink cartridge. The ink chamber accommodates therein ink and is disposed in the main body. The first valve is movable between: a first position closing the opening to interrupt a communication between the ink chamber and the opening; and a second position opening the opening to allow the communication between the ink chamber and the opening. The first urging member urges the first valve from the second position toward the first position. The first contact surface is in contact with the first valve that is in the first position to prevent the first valve from further moving from the first position in a direction in which the first urging member urges the first valve that is in the first position. The first pressing member has a first pressing surface. The cartridge-attachment portion includes an ink supply member, a second valve, a second urging member, a second contact surface, and a second pressing member. The ink supply member extends in a second direction opposite to the first direction and provides therein an ink passage allowing ink to flow therethrough. The ink supply member is formed with an inlet opening for communicating the ink passage with an outside of the cartridge-attachment portion. The second valve is movable between: a third position closing the inlet opening to interrupt a communication between the ink passage and the outside of the cartridge-attachment portion; and a fourth position opening the inlet opening to allow the communication between the ink passage and the outside of the cartridge-attachment portion. The second urging member urges the second valve from the fourth position toward the third position. The second contact surface is in contact with the second valve that is in the third position to prevent the second valve from further moving from the third position in a direction in which the second urging member urges the second valve that is in the third position. The second pressing member has a second pressing surface. In the attachment process, at least a portion of the ink supply member is inserted into the ink chamber through the opening, the first pressing surface presses the second valve to move the second valve from the third position to the fourth position, and the second pressing surface presses the first valve to move the first valve from the first position to the second position. In an attached state in which the ink cartridge is attached to the cartridge-attachment portion, the inlet opening is opened and positioned in the ink chamber, the ink passage is in communication with the ink chamber through the inlet opening, and the ink accommodated in the ink chamber is supplied to the recording head through the ink passage.

BRIEF DESCRIPTION OF THE DRAWINGS

The particular features and advantages of the present disclosure will become apparent from the following description taken in connection with the accompanying drawings, in which.

DETAILED DESCRIPTION

Figure 1A:
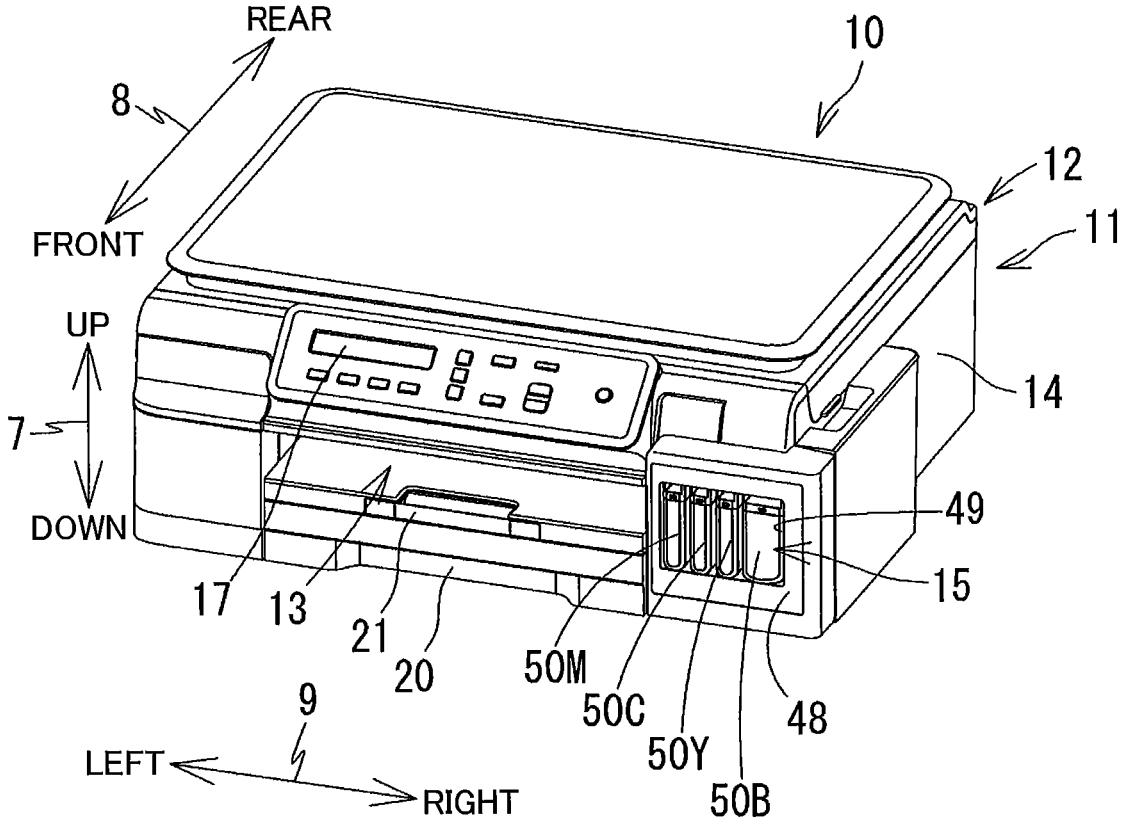
FIG. 1A is a perspective view of an MFP according to an embodiment of the present disclosure, the view illustrating a state in which a cover of the MFP is in a closed posture.

Next, a multifunction peripheral 10 (hereinafter, simply referred to as "MFP 10") according to an embodiment of the present disclosure will be described while referring to the accompanying drawings. Note that it would be apparent to those skilled in the art that the embodiment described below is merely an example of the present disclosure and modifications and variations may be made to the embodiment.

In the following description, an up-down direction 7 is defined based on the orientation of the MFP 10 when the MFP 10 is resting on a level surface and is ready to use (the orientation illustrated in FIG. 1; hereinafter called its "operable posture"); a front-rear direction 8 is defined so that the side of the MFP 10 in which an opening 13 is formed constitutes the front side; and a left-right direction 9 is defined based on the perspective of an observer facing the front side of the MFP 10. In the present embodiment, the up-down direction 7 when the MFP 10 is in its operable posture corresponds to the vertical direction; and each of the front-rear direction 8 and left-right direction 9 corresponds to the horizontal direction.

Further, in the following description, the directions (i.e., the up-down direction 7, the front-rear direction 8, and the left-right direction 9) defined above are also used for ink cartridges 50 attachable to a cartridge-attachment portion 80 of the MFP 10. More specifically, the directions defined above are used based on the posture of the ink cartridge 50 when the ink cartridge 50 is attached to the cartridge-attachment portion 80 of the MFP 10 that is in its operable posture (the posture illustrated in FIG. 1; hereinafter called its "upright posture").

Hereinafter; an upward direction in the up-down direction 7 and a downward direction in the up-down direction 7 will be simply referred to as "upward direction" and "downward direction", respectively; a frontward direction in the front-rear direction 8 and a rearward direction in the front-rear direction 8 will be simply referred to as "frontward direction" and "rearward direction", respectively; and a leftward direction in the left-right direction 9 and a rightward direction in the left-right direction 9 will be simply referred to as "leftward direction" and "rightward direction", respectively.

The Present Embodiment

As illustrated in FIG. 1, the MFP 10 has a generally rectangular parallelepiped shape. The MFP 10 includes a printer portion 11, a scanner portion 12, and an operation panel 17. The MFP 10 is an example of the inkjet recording apparatus of the present disclosure.

The printing portion 11 constitutes the lower section of the MFP 10. The printer portion 11 is configured to record images on sheets according to an inkjet recording method. The printer portion 11 includes a housing 14 and an ink supplying device 15. The housing 14 is formed with the opening 13 opening in the frontward direction. The opening 13 is formed at the center in the left-right direction 9 of the front surface of the MFP 10. The ink supplying device 15 is accommodated in the housing 14 and positioned to the right of the opening 13.

The scanner portion 12 possesses a scan function and is positioned above the printer portion 11. The operation panel 17 receives various user's operation instructing the MFP to perform various functions. Based on a user's operation to the operation panel 17, the MFP 10 records images on sheets using the printer portion 11. Based on another user's operation to the operation panel 17, the MFP 10 reads an image using the scanner portion 12.

[Sheet Tray 20 and Discharge Tray 21]

Figure 1B:
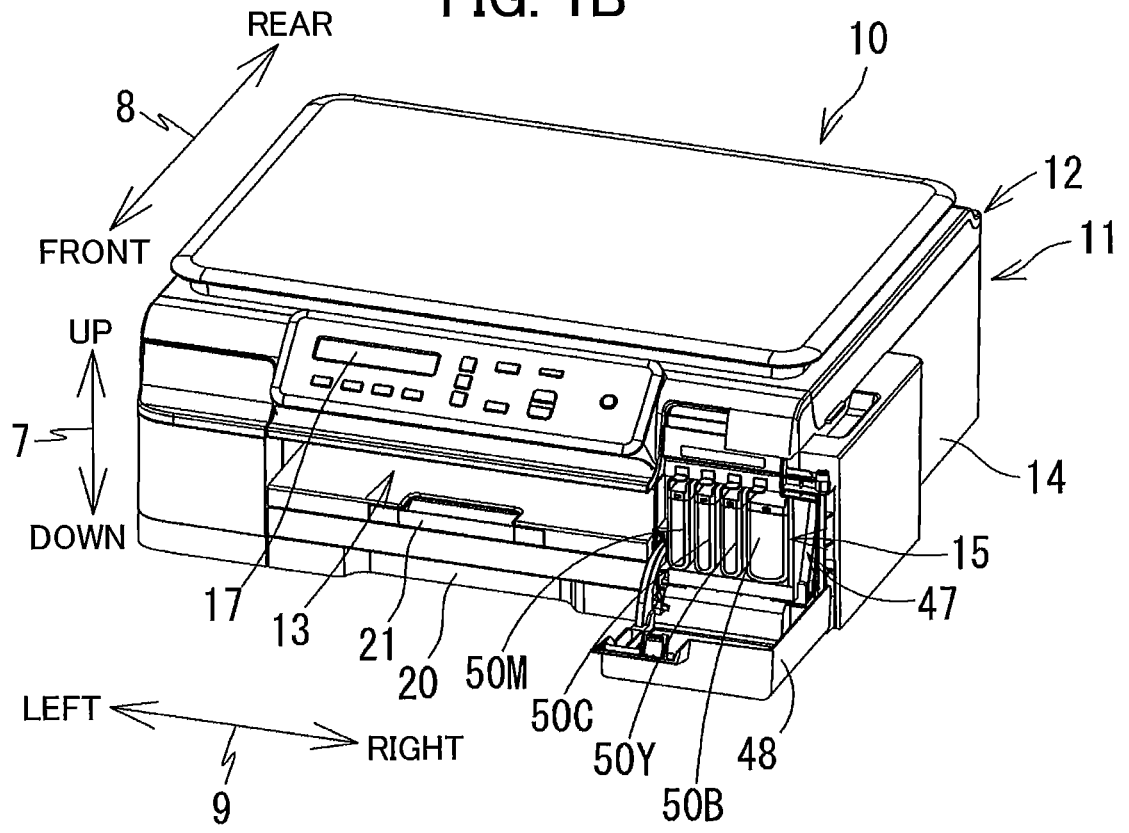
FIG. 1B is a perspective view of the MFP according to the embodiment, the view illustrating a state in which the cover is in an open posture.
Figure 2:
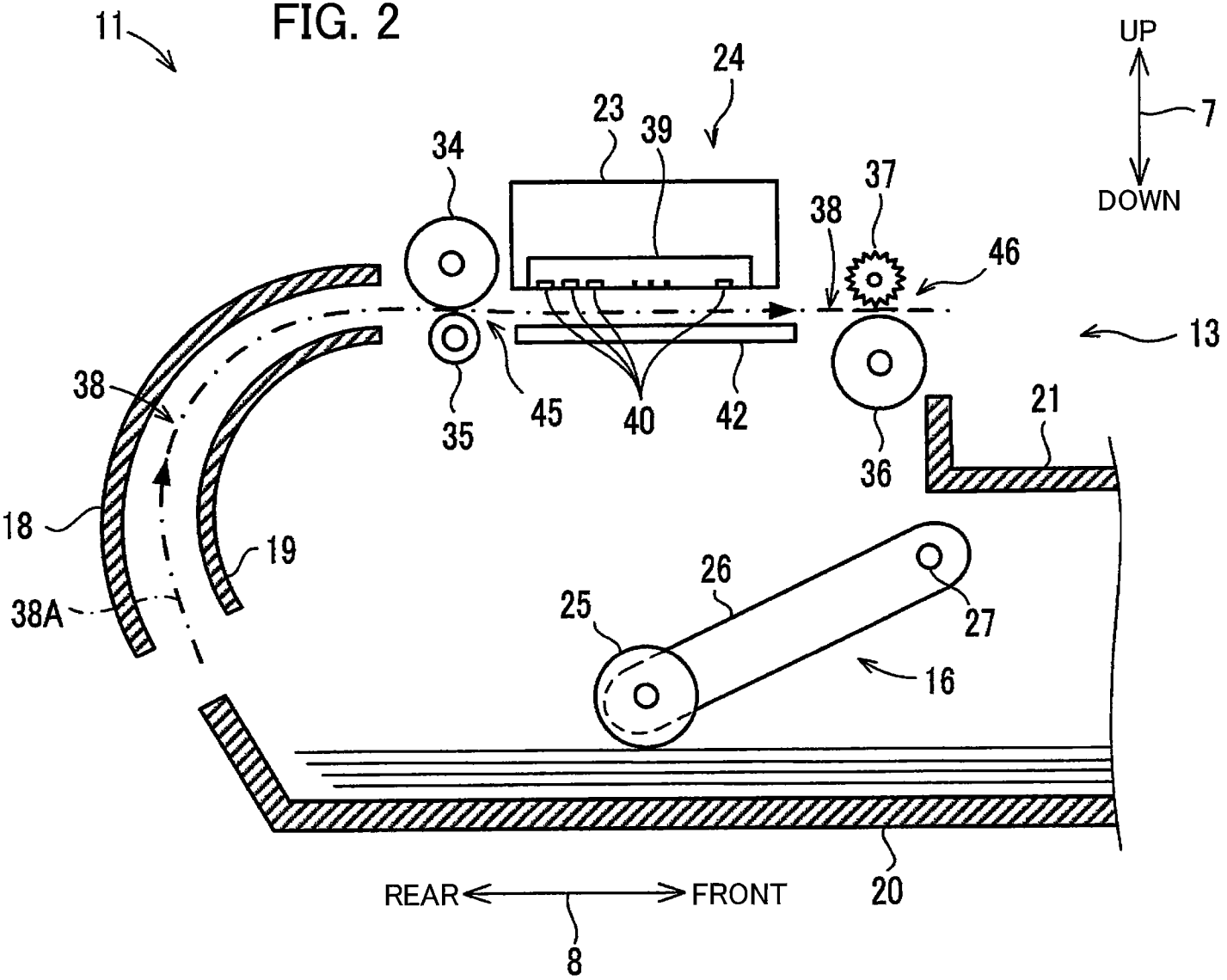
FIG. 2 is a vertical cross-sectional view schematically illustrating an internal structure of a printing portion of the MFP according to the embodiment.

As illustrated in FIGS. 1A and 1B, a sheet tray 20 can be inserted into and removed from the housing 14 through the opening 13 in the front-rear direction 8. As illustrated in FIG. 2, the sheet tray 20 can support a plurality of sheets in a stacked state. A discharge tray 21 is disposed above the sheet tray 20. The discharge tray 21 is inserted and removed together with the sheet tray 20 in the front-rear direction 8. The discharge tray 21 supports sheets discharged by a pair of discharge rollers 46 (see FIG. 2).

[Feeding Portion 16]

A feeding portion 16 will be described while referring to FIG. 2. The feeding portion 16 is configured to feed the sheets supported in the sheet tray 20 onto a conveying path 38. As illustrated in FIG. 2, the feeding portion 16 includes a feed roller 25, a feed arm 26, and a shaft 27.

The feed roller 25 is rotatably supported at the tip of the feed arm 26. The feed roller 25 is driven by a feed motor (not illustrated). The feed arm 26 is pivotally movably supported by the shaft 27. The shaft 27 is supported by a frame of the printer portion 11. The feed arm 26 is urged to pivotally move toward the sheet tray 20 by its own weight or an elastic force of a spring, for example.

Hereinafter, of the rotational directions of each of the feed roller 25, a conveying roller 34, and a discharge roller 36 which are involved in conveying a sheet, the rotational direction of each roller for conveying the sheet in a conveying direction 38A is referred to as "normal rotational direction".

[Conveying Path 38]

As illustrated in FIG. 2, the conveying path 38 represents a space that is formed within the printing portion 11 by an inner guide member 18 and an outer guide member 19 and the like. The outer guide member 18 and the inner guide member 19 face each other with a prescribed gap therebetween.

The conveying path 38 extends rearward and diagonally above from the rear end portion of the sheet tray 20. Specifically, the conveying path 38 extends rearward and diagonally above at the rear portion of the printing portion 11, curves back in the frontward direction, passes through the area between a recording portion 24 and a platen 42, and reaches the discharge tray 21.

Figure 3:
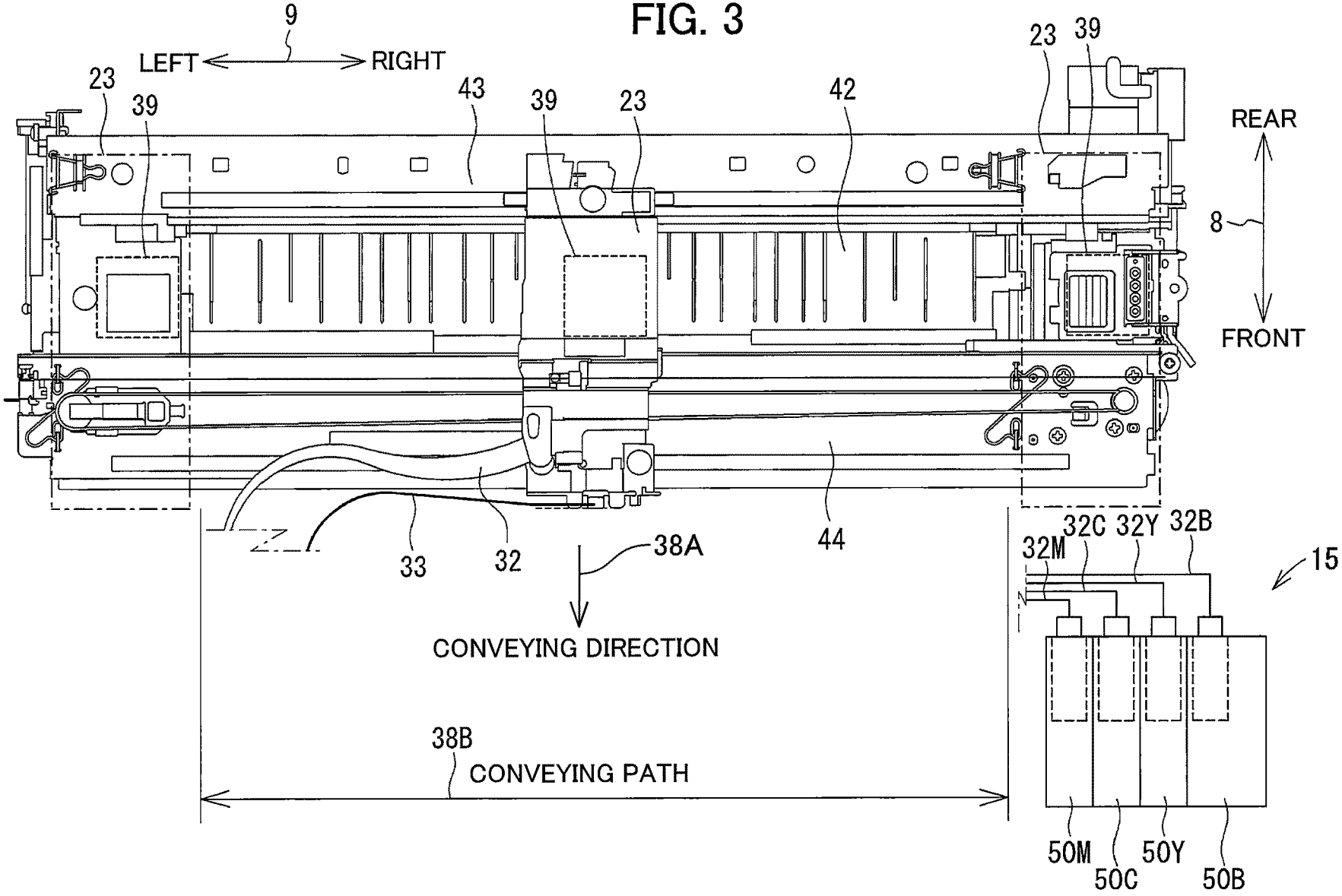
FIG. 3 is a plan view illustrating a layout of a carriage and an ink supplying device of the MFP according to the embodiment.

As illustrated in FIGS. 2 and 3, the conveying path 38 includes a path that extends in the front-rear direction 8 between a pair of conveying rollers 45 and the pair of discharge rollers 46. The path between the pair of conveying rollers 45 and the pair of discharge rollers 46 is provided approximately at the center in the left-right direction 9 of the MFP 10. The conveying direction 38A of a sheet in the conveying path 38 is indicated by an arrow depicted in FIG. 2.

[Pair of Conveying Rollers 45]

As illustrated in FIG. 2, the pair of conveying rollers 45 is positioned upstream of the recording portion 24 in the conveying direction 38A. The pair of conveying rollers 45 includes the conveying roller 34 and a pinch roller 35 which face each other. The conveying roller 34 is driven by a conveying motor (not illustrated) to rotate in the normal rotational direction or reverse rotational direction. The pinch roller 35 rotates along with the rotation of the conveying roller 34. A sheet is conveyed in the conveying direction 38A by the conveying roller 34 rotating in the normal rotational direction and the pinch roller 35 while being pinched therebetween.

[Pair of Discharge Rollers 46]

As illustrated in FIG. 2, the pair of discharge rollers 46 is positioned downstream of the recording portion 24 in the conveying direction 38A. The pair of discharge rollers 46 includes the discharge roller 36 and a spur 37 which face each other. The discharge roller 36 is driven by a conveying motor (not illustrated) to rotate in the normal rotational direction or reverse rotational direction. The spur 37 rotates along with the rotation of the discharge roller 36. A sheet is conveyed in the conveying direction 38A by the discharge roller 36 rotating in the normal rotational direction and the spur 37 while being pinched therebetween.

[Recording Portion 24]

As illustrated in FIG. 2, the recording portion 24 is positioned between the pair of conveying rollers 45 and the pair of discharge rollers 46 in the conveying direction 38A. The recording portion 24 and the platen 42 face each other in the up-down direction 7 with the conveying path 38 interposed therebetween. The recording portion 24 includes a carriage 23 and a recording head 39 mounted thereon.

As illustrated in FIG. 3, the carriage 23 extends in the front-rear direction 8. The carriage 23 is supported by guide rails 43 and 44, each of which extends in the left-right direction 9. The guide rails 43 and 44 are supported by the frame (not illustrated).

The carriage 23 is coupled to a known belt mechanism provided on the guide rail 44. The belt mechanism is driven by a carriage drive motor (not illustrated). As the belt mechanism is driven, the carriage 23 reciprocates in the left-right direction 9 while being guided by the guide rails 43 and 44.

As illustrated with a one-dot chain line in FIG. 3, a movement range of the carriage 23 is wider in the left-right direction 9 than a width 38B of the conveying path 38. That is, the right end of the movement range is positioned further in the rightward direction than the right end edge of the width 38B and the left end of the movement range is positioned further in the leftward direction than the left end edge of the width 38B.

As illustrated in FIG. 3, the recording head 39 and the ink supplying device 15 are connected by four ink tubes 32. Specifically, the recording head 39 is connected by the four ink tubes 32 to four sub tanks 100 (100M, 100C, 100Y, and 100B) which are provided in the ink supplying device 15. The recording head 39 is also connected to a control board (not illustrated) by a flexible flat cable 33.

The four ink tubes 32 include a magenta ink tube 32M, a cyan ink tube 32C, a yellow ink tube 32Y, and a black ink tube 32B. When the four ink tubes 32M, 32C, 32Y, and 32B are not required to be specifically distinguished in the specification, the four ink tubes 32M, 32C, 32Y, and 32B are generally referred to as the ink tubes 32. The four ink tubes 32 are bundled together.

The flexible flat cable 33 electrically connects the recording head 39 and the control board mounted with a controller. The flexible flat cable 33 transmits, to the recording head 39, control signals which the controller outputs.

As illustrated in FIG. 2, a plurality of nozzles 40 are disposed on a lower surface of the recording head 39. Tips of the plurality of nozzles 40 are exposed from the lower surface of the recording head 39. The recording head 39 is configured to eject ink from the nozzles 40 in a form of fine ink droplets. The recording head 39 ejects ink droplets onto the sheet supported on the platen 42 while the carriage 23 reciprocates. With the configuration, an image is recorded on the sheet and thus the ink stored in each of the four sub tanks 100 is consumed.

[Platen 42]

As illustrated in FIGS. 2 and 3, the platen 42 is disposed between the pair of conveying rollers 45 and the pair of discharge rollers 46 in the conveying path 38. The platen 42 is disposed to face the recording portion 24 in the up-down direction 7 with the conveying path 38 interposed therebetween. The platen 42 supports a sheet, which is conveyed by the pair of conveying rollers 45, from below the sheet.

[Cover 48]

As illustrated in FIG. 1B, an opening 47 is formed at a front-right portion of the housing 14. The housing 14 accommodates therein the ink supplying device 15. The front surface of the ink supplying device 15 is exposed via the opening 47. The housing 14 is attached with a cover 48 configured to open and close the opening 47. The lower end portion of the cover 48 is supported by the housing 14 so that the cover 48 can pivotally move about an axis that is positioned below the opening 47 and extends in the left-right direction 9. The cover 48 is pivotally movable between a closed posture closing the opening 47 (the posture illustrated in FIG. 1A) and an open posture opening the opening 47 (the posture illustrated in FIG. 1B).

As illustrated in FIG. 1A, the cover 48 includes a light-transmission portion 49. The light-transmission portion 49 has translucency to allow the inside of the hosing 14 to be visually recognized from the outside of the cover 48. When the cover 48 is at its closed posture, the front surface of the ink cartridges 50 that have been attached to the cartridge-attachment portion 80 can be visually recognized through the light-transmission portion 49.

[Ink Supplying Device 15]

Figure 4:
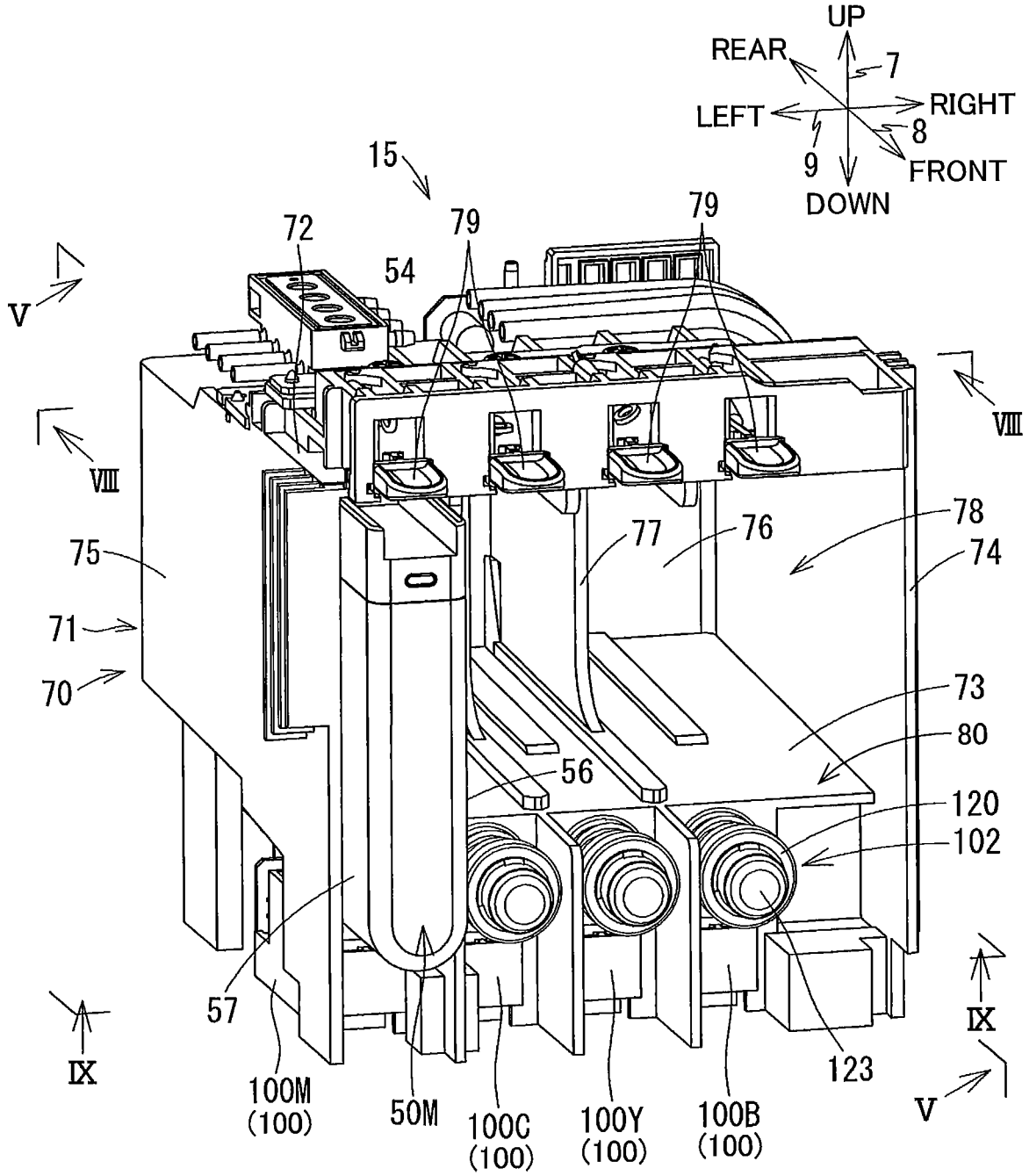
FIG. 4 is a perspective view, as viewed from the front left side, of the ink supplying device of the MFP according to the embodiment.
Figure 5:
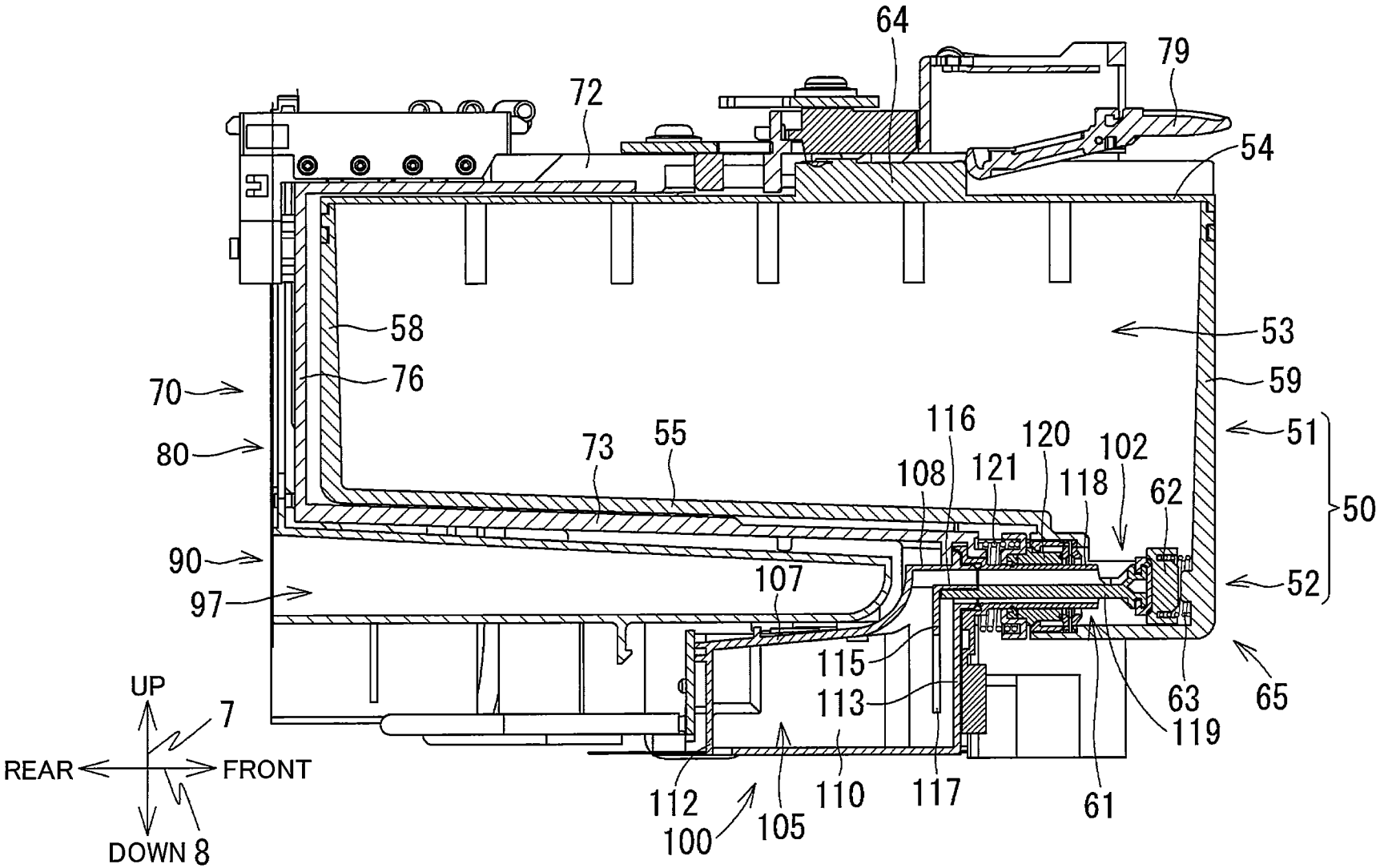
FIG. 5 is a cross-sectional view taken along a line V-V depicted in FIG. 4.
Figure 11:
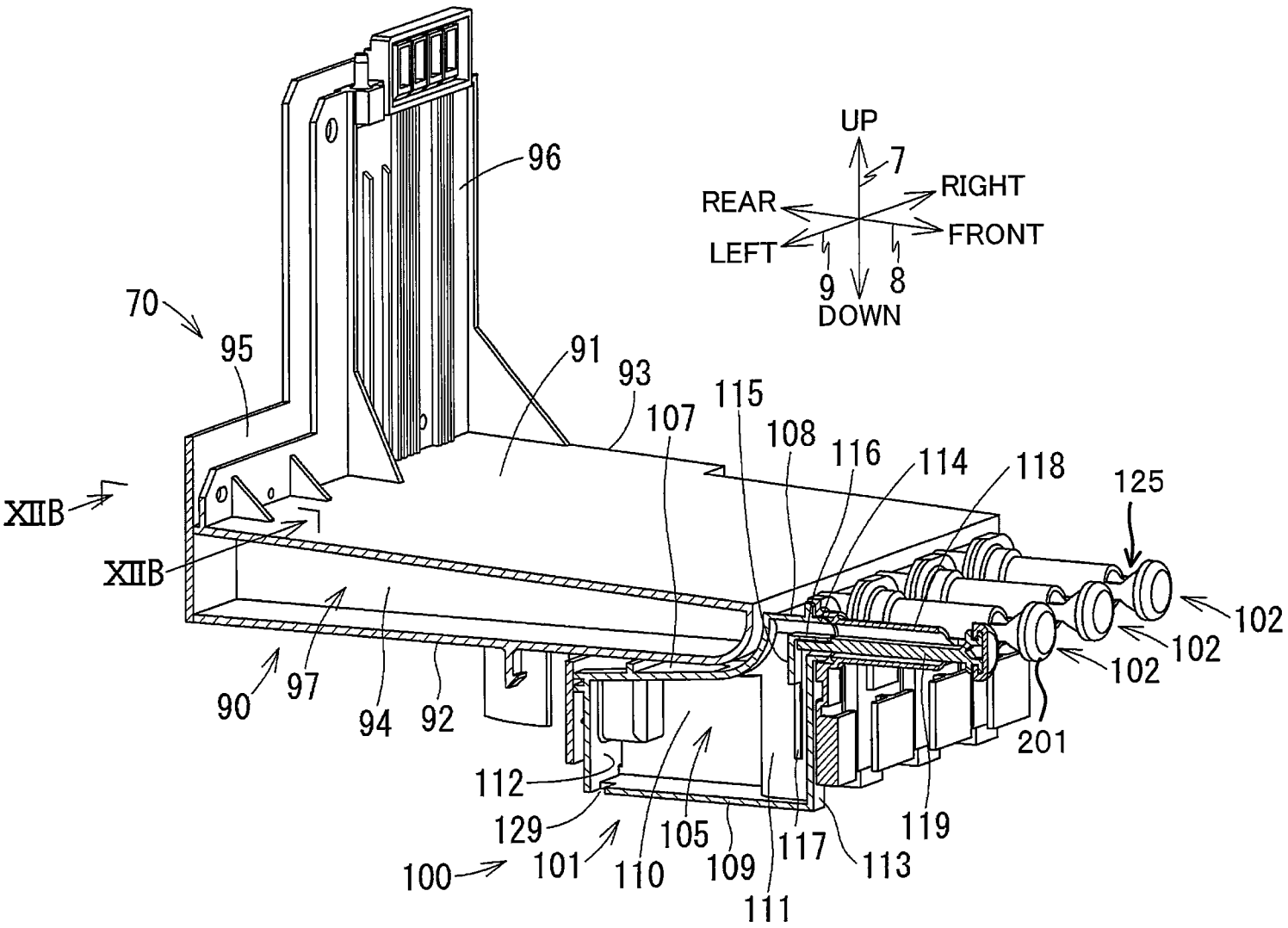
FIG. 11 is a perspective view, as viewed from the front left side, of the sub tank and a buffer tank of the MFP according to the embodiment.

As illustrated in FIGS. 1 and 4, the ink supplying device 15 is provided with the four ink cartridges 50, the cartridge-attachment portion 80, and an atmosphere communication portion 70 (see FIGS. 5 and 11).

[Ink Cartridge 50]

As illustrated in FIGS. 1 and 3, the four ink cartridges 50 include a magenta ink cartridge 50M, a cyan ink cartridge 50C, a yellow ink cartridge 50Y, and a black ink cartridge 50B. When the magenta ink cartridge 50M, the cyan ink cartridge 50C, the yellow ink cartridge 50Y, and the black ink cartridge 50B are not required to be specifically distinguished in the specification, the magenta ink cartridge 50M, the cyan ink cartridge 50C, the yellow ink cartridge 50Y, and the black ink cartridge 50B are generally referred to as the ink cartridges 50.

FIG. 4 illustrates a state in which, among the four ink cartridges 50, only the magenta ink cartridge 50M that is positioned at the leftmost position in the left-right direction 9 is attached to the attachment portion 80. More specifically, FIG. 4 illustrates a state in which only the magenta ink cartridge 50M is accommodated in an accommodation case 71 of the attachment portion 80.

As illustrated in FIG. 5, the ink cartridge 50 includes a cartridge body 51 and a joint receiving portion 52. The cartridge body 51 has a first storage chamber 53. The first storage chamber 53 stores or accommodates therein ink and is disposed in the cartridge body 51. The cartridge body 51 and the joint receiving portion 52 are an example of the main body of the present disclosure. The first storage chamber 53 is an example of the ink chamber of the present disclosure.

The cartridge body 51 has a generally rectangular parallelepiped box shape. The cartridge body 51 has a generally rectangular shape not only when viewed in the up-down direction 7 but also when viewed in the front-rear direction 8. The cartridge body 51 has a protruding portion 65 at its front end portion. The protruding portion 65 protrudes in the downward direction.

Figure 6:
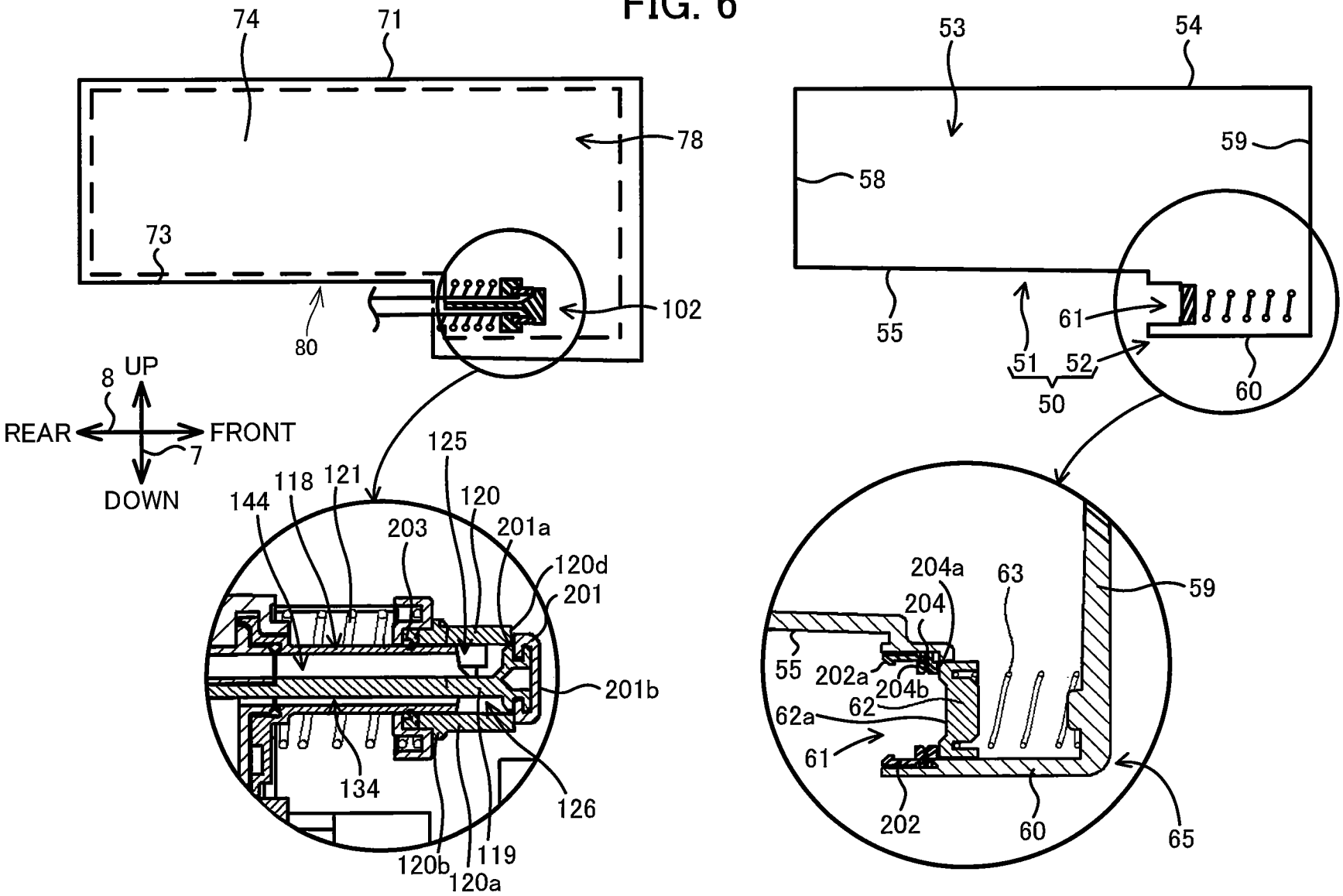
FIG. 6 is a view schematically illustrating an ink cartridge and a cartridge-attachment portion of the MFP according to the embodiment in a separated state in which the ink cartridge is not attached to the cartridge-attachment portion and thus is separated from the same.

The cartridge body 51 has an upper wall 54, a sub lower wall 55, a right wall 56 (see FIG. 4), a left wall 57 (see FIG. 4), a rear wall 58, a front wall 59, and a lower wall 60 (see FIG. 6). The lower wall 60 is positioned at the lower end portion of the front portion of the cartridge body 51. The lower wall 60 is positioned further in the downward direction than the sub lower wall 55. The sub lower wall 55 is positioned further in the rearward direction than the lower wall 60.

The cartridge body 51 is formed with a receiving opening 61 at the protruding portion 65. The receiving opening 61 is an opening for receiving a joint body 118 of the cartridge-attachment portion 80 (described later). The receiving opening 61 opens in the rearward direction, that is, the receiving opening 61 opens to the outside of the ink cartridge 50. The receiving opening 61 is defined by the sub lower wall 55, the lower wall 60, the right wall 56, and the left wall 57. The receiving opening 61 is an example of the opening of the present disclosure. The rearward direction is an example of the first direction of the present disclosure. The frontward direction is an example of the second direction of the present disclosure.

As illustrated in FIG. 5, the upper wall 54 is provided with an abutting portion 64 at its center in the front-rear direction 8. The abutting portion 64 protrudes in the upward direction. The abutting portion 64 configured to come into contact with a lock lever 79 of the accommodation case 71.

The joint receiving portion 52 has a cylindrical shape extending in the front direction from a portion of the cartridge body 51 which portion surrounds the receiving opening 61. The joint receiving portion 52 is a portion configured to receive a joint 102 of the sub tank 100 of the attachment portion 80. Specifically, the joint receiving portion 52 is a portion into which the joint 102 of the sub tank 100 is inserted.

FIG. 5 illustrates a state in which the ink cartridge 50 has been mounted to the sub tank 100, i.e., an attached state in which the ink cartridge 50 has been attached to the cartridge-attachment portion 80. FIG. 6 illustrates a state in which the ink cartridge 50 has not been mounted to the sub tank 100 and thus is separated from the sub tank 100, i.e., a separated state in which the ink cartridge 50 has not been attached to the cartridge-attachment portion 80 and thus is separated from the cartridge-attachment portion 80.

As illustrated in FIG. 6, the joint receiving portion 52 is provided with a plug member 62, a spring 63, a second sealing member 202, and a third sealing member 204.

The plug member 62 is formed in an approximately columnar shape extending in front-rear direction 8 and has a surface 62*a*. The surface 62*a* constitutes the rear surface and faces in the rearward direction. The surface 62*a* is an example of the pressed surface of the present disclosure.

Figure 7:
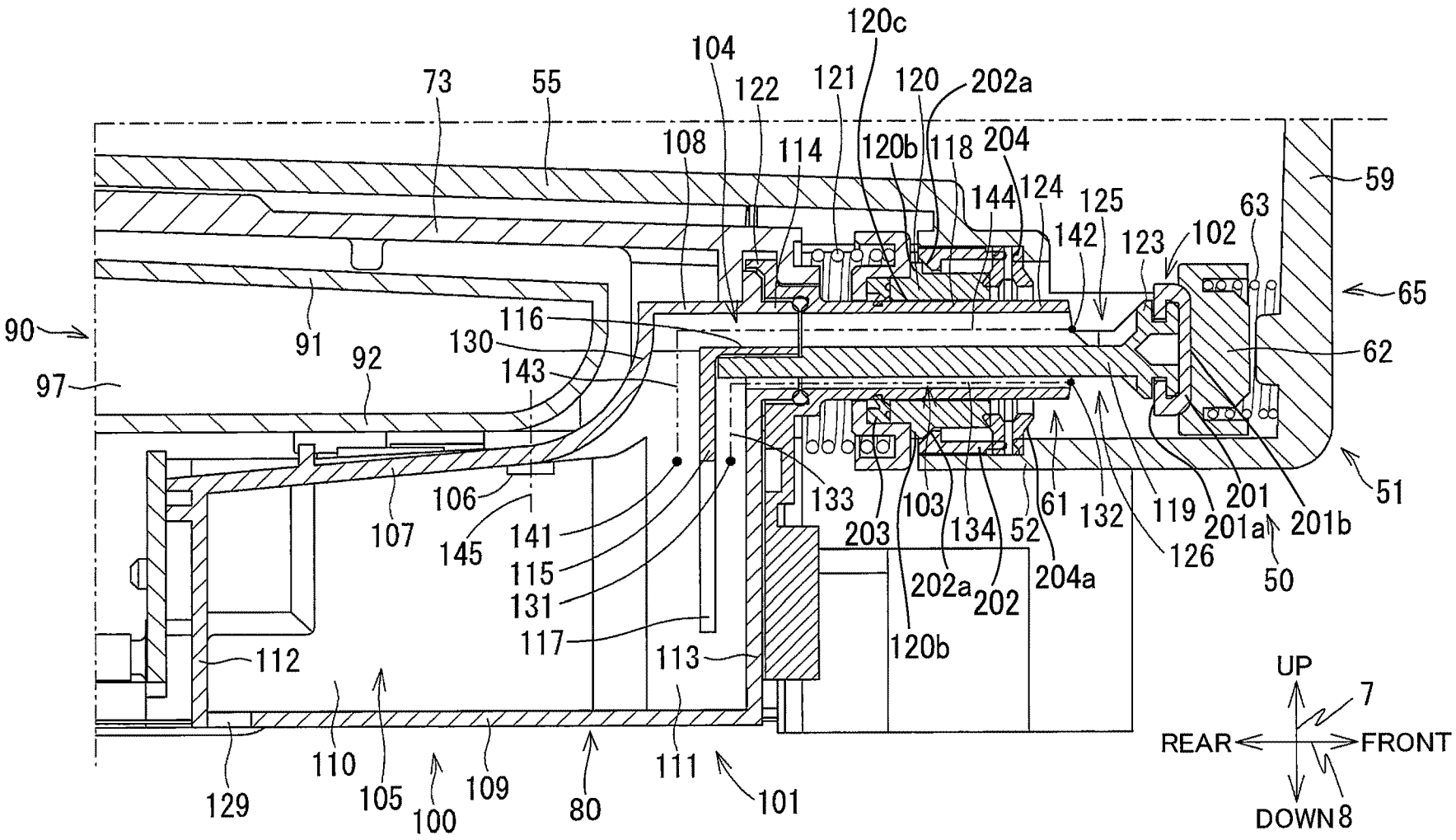
FIG. 7 is an enlarged view of FIG. 5, the enlarged view illustrating the vicinity of a sub tank of the MFP according to the embodiment in an attached state in which the ink cartridge is attached to the cartridge-attachment portion.

The plug member 62 can close the receiving opening 61. More specifically, the plug member 62 is movable in the front-rear direction 8 between a first closed position illustrated in FIG. 6 and a first open position illustrated in FIGS. 5 and 7. In the first closed position, as illustrated in FIG. 6, the plug member 62 closes the receiving opening 61 to interrupt a communication between the first storage chamber 53 and the receiving opening 61. In the first open position, as illustrated in FIG. 7, the plug member 62 opens the receiving opening 61 to allow the communication between the first storage chamber 53 and the receiving opening 61. In this way, the plug member 62 serves as a valve opening and closing the receiving opening 61. The plug member 62 is an example of the first valve of the present disclosure. The first closed position is an example of the first position of the present disclosure. The first open position is an example of the second position of the present disclosure.

The spring 63 extends in the front-rear direction 8 between the plug member 62 and the front wall 59. The spring 63 urges the plug member 62 in the rearward direction. That is, the spring 63 urges the plug member 62 from the first open position toward the first closed position. The spring 63 can be compressed in the front-rear direction 8. The spring 63 is an example of the first urging member of the present disclosure.

While no external force is applied to the ink cartridge 50, the plug member 62 is positioned in the first closed position and is in contact with a surface 204*a* of the third sealing member 204 by the urging force in the rearward direction of the spring 63. The surface 204*a* constitutes the front surface of the third sealing member 204 and faces in the frontward direction. As described above, at the first closed position, the receiving opening 61 is closed by the plug member 62. The surface 204*a* is an example of the first contact surface of the present disclosure.

On the other hand, as illustrated in FIGS. 5 and 7, when an external force in the frontward direction that is greater than the urging force of the spring 63 is applied to the plug member 62 by the joint 102, the plug member 62 is moved in the frontward direction relative to the accommodation case 71 to thereby move from the first closed position to the first open position against the urging force of the spring 63. As described above, at the first open position of the plug member 62, the receiving opening 61 is opened.

The third sealing member 204 is fixed to the inner surface of the rear end portion of the joint receiving portion 52. The third sealing member 204 serves as a member configured to restrict the plug member 62 from moving in the rearward direction. The contact between the plug member 62 and the surface 204*a* of the third sealing member 204 maintains the plug member 62 at the first closed position against the urging force of the spring 63. That is, when the plug member 62 is in the first closed position, the surface 204*a* is in contact with the plug member 62 to thereby prevent the plug member 62 from further moving in the rearward direction (i.e., in a direction in which the spring 63 urges the plug member 62 that is in the first closed position) from the first closed position. Detailed descriptions of the second sealing member 202 and the third sealing member 204 will be made later.

[Cartridge-Attachment Portion 80]

The attachment portion 80 is a portion to which the four ink cartridges 50 are detachably attachable. The attachment portion 80 includes the accommodation case 71 and the four sub tanks 100. In a process of attaching the ink cartridge 50 to the attachment portion 80, the ink cartridge 50 is inserted into the attachment portion 80 in the rearward direction. That is, in the present embodiment, an insertion direction of the ink cartridge 50 into the attachment portion 80 is the rearward direction. Further, in a process of detaching the ink cartridge 50 from the attachment portion 80, the ink cartridge 50 is removed from the attachment portion 80 in the frontward direction. Hereinafter, the process of attaching the ink cartridge 50 to the attachment portion 80 and the process of detaching the ink cartridge 50 from the attachment portion 80 will be simply referred to as "attachment process" and "detachment process", respectively.

[Accommodation Case 71]

As illustrated in FIG. 4, the accommodation case 71 has a rectangular parallelepiped box shape that opens in the frontward direction. The accommodation case 71 has an upper wall 72, a lower wall 73, a right wall 74, a left wall 75, a rear wall 76, and three partition walls 77.

The upper wall 72, the lower wall 73, the right wall 74, the left wall 75, and the rear wall 76 define an interior space 78 that opens in the frontward direction. The three partition walls 77 are parallel to the right wall 74 and the left wall 75 and partition the interior space 78 into four spaces. Each of the four partitioned spaces can accommodate the corresponding one of the four ink cartridges 50.

[Sub Tank 100]

As illustrated in FIG. 4, the sub tanks 100 are positioned below the lower wall 73 of the accommodation case 71.

As illustrated in FIG. 7, each of the sub tanks 100 includes a tank body 101 and the joint 102. A second storage chamber 105 for storing ink is provided in the tank body 101. Each of the sub tanks 100 further includes a liquid passage 103 and a gas passage 104, each of which is in communication with the second storage chamber 105. Further, each of the sub tanks 100 is formed with an atmosphere communication opening 106 (see FIGS. 9, 10, and 12A) through which the second storage chamber 105 is communicated with the atmosphere.

[Liquid Passage 103 and Gas Passage 104]

As illustrated in FIG. 7, the liquid passage 103 and the gas passage 104 are formed over the interior of the tank body 101 and the interior of the joint 102. That is, the tank body 101 and the joint body 118 provide therein, in cooperation with each other, the liquid passage 103 and the gas passage 104. The liquid passage 103 and the gas passage 104 are arranged in parallel to each other in the up-down direction 7. The liquid passage 103 is an example of the ink passage of the present disclosure. The gas passage 104 is an example of the air passage of the present disclosure.

The liquid passage 103 has a first opening 131 and a second opening 132. The liquid passage 103 allows ink to flow therethrough. The liquid passage 103 includes a vertical passage 133 and a horizontal passage 134.

The first opening 131 is formed at one end side (rear end side) of the liquid passage 103. The first opening 131 opens in the up-down direction 7 and is in communication with the second storage chamber 105.

The second opening 132 is formed on the other end side (front end side) of the liquid passage 103 which is opposite to the one end side. The second opening 132 opens in the front-rear direction 8. The second opening 132 opens to the outside of the liquid passage 103. In the attached state of the ink cartridge 50, the second opening 132 is positioned inside the first storage chamber 53 and the liquid passage 103 is in communication with the first storage chamber 53 through the second opening 132.

The vertical passage 133 extends in the upward direction from the opening 131. The horizontal passage 134 extends in the rearward direction from the second opening 132. The upper end portion of the vertical passage 133 is connected to the rear end portion of the horizontal passage 134.

The gas passage 104 has a first opening 141 and a second opening 142. The gas passage 104 allows air to flow therethrough. The gas passage 104 includes a vertical passage 143 and a horizontal passage 144.

The first opening 141 is formed at one end side (rear end side) of the gas passage 104. The first opening 141 opens in the up-down direction 7 and is in communication with the second storage chamber 105.

The second opening 142 is formed at the other end side (front end side) of the gas passage 104 which is opposite to the one end side. The second opening 142 opens in the front-rear direction 8. The second opening 142 opens to the outside of the gas passage 104. In the attached state of the ink cartridge 50, the second opening 142 is positioned inside the first storage chamber 53 and the gas passage 104 is in communication with the first storage chamber 53 through the second opening 142.

The vertical passage 143 extends in the upward direction from the first opening 141. The horizontal passage 144 extends in the rearward direction from the second opening 142. The upper end portion of the vertical passage 143 is connected to the rear end portion of the horizontal passage 144.

[Tank Body 101]

The tank body 101 has an outer wall formed in a generally rectangular parallelepiped shape. The tank body 101 has an approximate T-shape (see FIGS. 9 and 10) when viewed in the up-down direction 7. The tank body 101 has a generally rectangular shape (see FIG. 8) when viewed in the front-rear direction 8. The tank body 101 has an approximate L-shape (see FIGS. 4 to 7) when viewed in the left-right direction 9.

As illustrated in FIG. 7, the outer wall of the tank body 101 has a rear upper wall 107, a curved upper wall 130, a front upper wall 108, a lower wall 109, two rear side walls 110, two curved front side walls 111, a rear wall 112, and a front wall 113.

The rear upper wall 107 extends frontward and diagonally above from its rear end. That is, the rear upper wall 107 is inclined relative to the horizontal plane such that the front end of the rear upper wall 107 is positioned further in the upward direction than the rear end of the rear upper wall 107. The curved upper wall 130 extends from the front end of the rear upper wall 107. The curved upper wall 130 is curved to have an approximately arc shape which is convex frontward and diagonally below. The front upper wall 108 extends in the frontward direction from the upper end of the curved upper wall 130. The front upper wall 108 is parallel to the horizontal plane.

Figure 9:
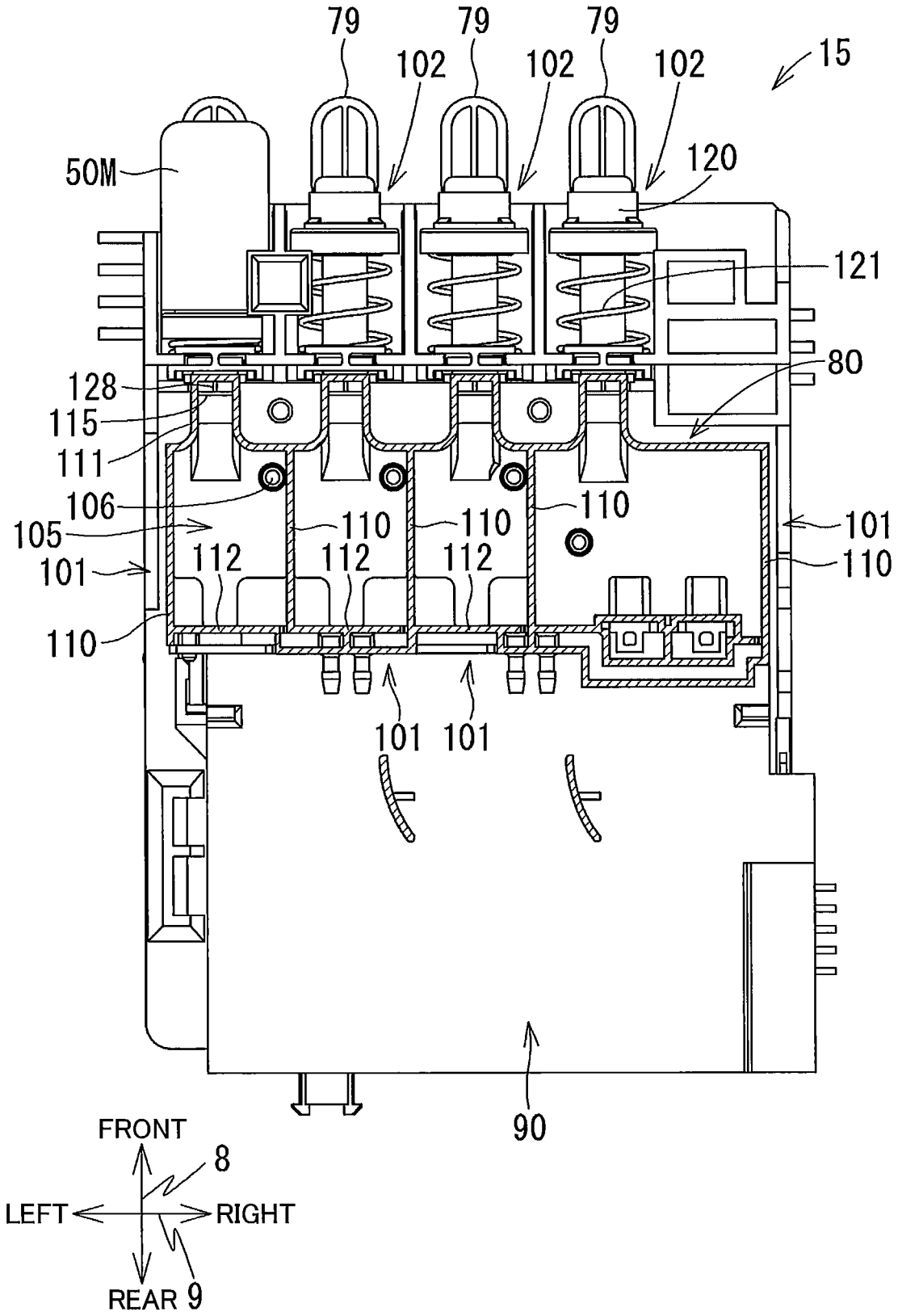
FIG. 9 is a cross-sectional view taken along a line IX-IX depicted in FIG. 4.

The lower wall 109 extends in the front-rear direction 8 and is parallel to the horizontal plane. The lower wall 109 has an approximate T-shape when viewed in the up-down direction 7. Each of the rear side walls 110 has a generally rectangular shape when viewed in the left-right direction 9. As illustrated in FIG. 9, the rear side wall 110 is shared by the neighboring two tank bodies 101 which store different inks.

The curved front side walls 111 connect the lower wall 109 with both of the curved upper wall 130 and the front upper wall 108 in the up-down direction 7. Each of the curved front side walls 111 has a generally rectangular shape when viewed in the left-right direction 9. Each of the curved front side walls 111 has an L-shape when viewed in the up-down direction 7, the corner of which is curved in an arc shape.

The rear wall 112 extends in the upward direction from the rear end portion of the lower wall 109. The rear wall 112 is connected to the rear upper wall 107 and the two rear side walls 110 on both left and right sides of the rear wall 112. The front wall 113 extends from the front end portion of the lower wall 109. The front wall 113 is connected to the two curved front side walls 111 on both left and right sides of the front wall 113.

As illustrated in FIGS. 7 and 11, the lower wall 109 is formed with a communication opening 129. The communication opening 129 is in communication with the second storage chamber 105 and is connected with one end portion of the ink tube 32. Hence, the second storage chamber 105 and the recording head 39 are connected to and communicated with each other through the ink tube 32 and the communication opening 129.

As illustrated in FIGS. 7 and 11, an inner cylinder portion 114 is provided at the upper front end portion of the tank body 101. The inner cylinder portion 114 has a cylindrical shape extending in the front-rear direction 8. The inner cylinder portion 114 opens in the frontward direction. The inner cylinder portion 114 is constituted by the front wall 113, the front upper wall 108, and the two curved front side walls 111 on both left and right sides of the front wall 113. The rear end portion of the joint 102 can be attached to the inner cylinder portion 114. In a state in which the joint 102 is attached to the inner cylinder portion 114, the interior space of the inner cylinder portion 114 is in communication with the interior space of the joint 102.

[Wide Width Portion 150 and Narrow Width Portion 151]

Figure 10:
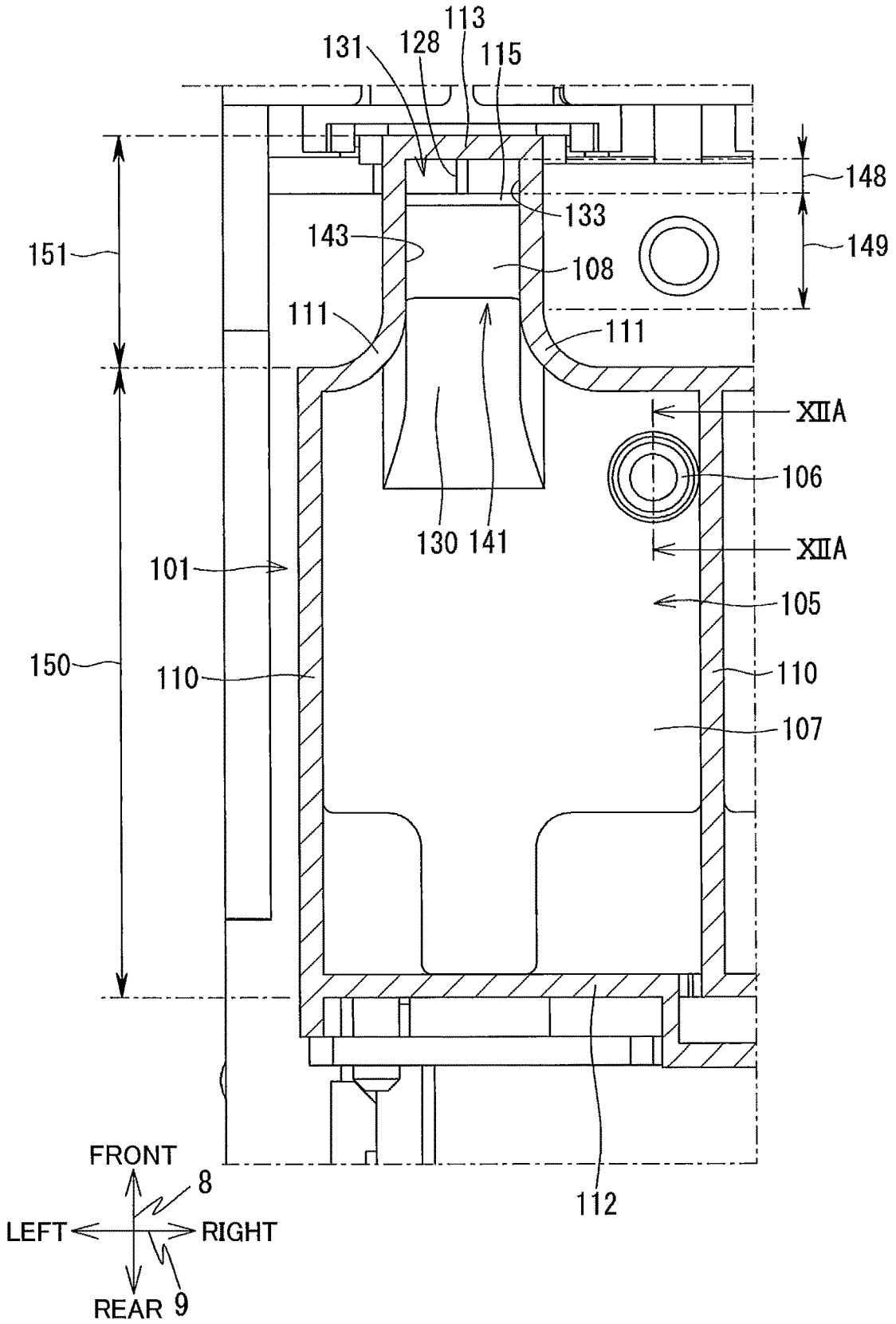
FIG. 10 is an enlarged view of FIG. 9, the enlarged view illustrating the vicinity of the sub tank of the MFP according to the embodiment.

As illustrated in FIG. 10, the tank body 101 has a wide width portion 150 and a narrow width portion 151 which are arranged in the front-rear direction 8.

The wide width portion 150 constitutes the rear portion of the tank body 101. The wide width portion 150 includes the two rear side walls 110 and the rear wall 112. The narrow width portion 151 constitutes the front end portion of the tank body 101. The narrow width portion 151 includes the two curved front side walls 111 and the front wall 113. A width of the narrow width portion 151 in the left-right direction 9 is smaller than a width of the wide width portion 150 in the left-right direction 9. The second storage chamber 105 is defined over the wide width portion 150 and the narrow width portion 151.

[Vertical Wall 115 and Horizontal Wall 116]

As illustrated in FIGS. 7 and 11, the tank body 101 further has a vertical wall 115 and a horizontal wall 116. The vertical wall 115 and the horizontal wall 116 are positioned at the upper front portion of the tank body 101.

The vertical wall 115 extends in the up-down direction 7. The vertical wall 115 is positioned between the front wall 113 and the curved upper wall 130 in the front-rear direction 8. The vertical wall 115 connects the two curved front side walls 111 on both left and right sides of the front wall 113. A space defined by the front wall 113, the front upper wall 108, and the two curved front side walls 111 is partitioned by the vertical wall 115 into two spaces arrayed in the front-rear direction 8.

The lower end of the vertical wall 115 is positioned at the same position in the up-down direction 7 as the first opening 131 of the liquid passage 103. Also, the lower end of the vertical wall 115 is positioned at the same position in up-down direction 7 as the first opening 141 of the gas passage 104. Further, the position in the up-down direction 7 of the lower end of the vertical wall 115 is the same as a position in the up-down direction 7 of the lower end of the front end of the rear upper wall 107.

The horizontal wall 116 extends in the frontward direction from the upper end of the vertical wall 115 to reach the interior space of the inner cylinder portion 114. The horizontal wall 116 connects the two curved front side walls 111 on both left and right sides of the front wall 113. The horizontal wall 116 further connects the right and left sides of the inner surface of the inner cylinder portion 114 in the left-right direction 9. A space defined by the front upper wall 108 and the two curved front side walls 111 is partitioned by the horizontal wall 116 into two spaces arrayed in the up-down direction 7. Further, a space defined by the inner cylinder portion 114 (i.e., the interior space of the inner cylinder portion 114) is partitioned by the horizontal wall 116 into two spaces arrayed in the up-down direction 7.

As illustrated in FIG. 10, the vertical passage 133 of the liquid passage 103 is defined by the vertical wall 115, the front wall 113, and the two curved front side walls 111. A cross section of the vertical passage 133 orthogonal to the up-down direction 7 has a rectangular shape. The vertical passage 133 continues and is flush with the two curved front side walls 111 defining the second storage chamber 105. With this configuration, a width in the left-right direction 9 of the vertical passage 133 is identical to a width in the left-right direction 9 of the second storage chamber 105 defined by the narrow width portion 151.

As illustrated in FIG. 10, the vertical passage 143 of the gas passage 104 is defined by the curved upper wall 130, the vertical wall 115, and the two curved front side walls 111. A cross section of the vertical passage 143 orthogonal to the up-down direction 7 has a rectangular shape. The vertical passage 143 continues and is flush with the two curved front side walls 111 defining the second storage chamber 105. With this configuration, a width in the left-right direction 9 of the vertical passage 143 is identical to the width in the left-right direction 9 of the second storage chamber 105 defined by the narrow width portion 151.

As illustrated in FIG. 10, a length 149 in the front-rear direction 8 of the first opening 141 of the gas passage 104 is longer than a length 148 in the front-rear direction 8 of the first opening 131 of the liquid passage 103. A length in the left-right direction 9 of the first opening 141 is identical to a length in the left-right direction 9 of the first opening 131. Accordingly, an opening area of the first opening 141 is greater than an opening area of the first opening 131.

As illustrated in FIG. 7, the opening area of the vertical passage 143 of the gas passage 104 increases toward the first opening 141. The opening area of the vertical passage 133 of the liquid passage 103 is constant in the up-down direction 7.

As illustrated in FIG. 7, the horizontal passage 134 of the liquid passage 103 has a tank-side part defined inside the tank body 101 and a joint-side part defined inside the joint 102. The tank-side part of the horizontal passage 134 (i.e., the horizontal passage 134 in the tank body 101) is defined by the horizontal wall 116, the two curved front side walls 111, and the inner cylinder portion 114.

Similarly to the horizontal passage 134, the horizontal passage 144 of the gas passage 104 has a tank-side part defined inside the tank body 101 and a joint-side part defined inside the joint 102. The tank-side part of the horizontal passage 144 (i.e., the horizontal passage 144 in the tank body 101) is defined by the front upper wall 108, the horizontal wall 116, the two curved front side walls 111, and the inner cylinder portion 114.

[First Rib 117]

As illustrated in FIGS. 7 and 11, the tank body 101 further has two first ribs 117 which continue to the vertical wall 115. One of the two first ribs 117 is provided at the curved front side walls 111 positioned on the right side of the front wall 113, whereas the remaining one of the two first ribs 117 is provided at the curved front side walls 111 positioned on the left side of the front wall 113. Each of the two first ribs 117 extends in the downward direction from the vertical wall 115 and protrudes inward from the corresponding curved front side wall 111. Each of the two first ribs 117 is spaced away from the lower wall 109. The two first ribs 117 are positioned away from each other in the left-right direction 9 within the second storage chamber 105.

[Layout of Ink Cartridge 50 and Sub Tank 100]

A layout of the ink cartridge 50 and the sub tank 100 will be described. The following description to the layout is based on a state (i.e., the state illustrated in FIG. 5) in which the MFP 10 is in the operable posture and the ink cartridge 50 is attached to the MFP 10 and is in the upright posture.

As illustrated in FIG. 5, a position in the up-down direction 7 of the protruding portion 65 of the ink cartridge 50 is approximately the same as a position in the up-down direction 7 of the joint 102. However, a portion of the ink cartridge 50 above the protruding portion 65 is higher than the joint 102. That is, most of the first storage chamber 53 of the ink cartridge 50 is positioned above the joint 102.

A position in the up-down direction 7 of the upper portion of the sub tank 100 (i.e., a portion of the sub tank 100 above the vicinity of the curved upper wall 130) is approximately the same as the position in the up-down direction 7 of the joint 102. However, a portion of the sub tank 100 below the vicinity of the curved upper wall 130 is positioned below the joint 102. That is, most of the second storage chamber 105 of the sub tank 100 is positioned below the joint 102.

A portion of the first storage chamber 53 above the protruding portion 65 is positioned further in the upward direction than both the horizontal passage 134 of the liquid passage 103 and the horizontal passage 144 of the gas passage 104. The second storage chamber 105 is positioned further in the downward direction than the horizontal passage 134 of the liquid passage 103 and the horizontal passage 144 of the gas passage 104. The lower portion of the first storage chamber 53 and the upper portion of the second storage chamber 105 are positioned on an axis extending in the front-rear direction 8. A volume of the first storage chamber 53 is greater than a volume of the second storage chamber 105.

The horizontal passage 144 of the gas passage 104 is positioned further in the upward direction than the horizontal passage 134 of the liquid passage 103.

As illustrated in FIG. 7, the receiving opening 61 of the first storage chamber 53, the first opening 131 of the liquid passage 103, the first opening 141 of the gas passage 104, and the atmosphere communication opening 106 are arranged in this order from the front to the rear. In other words, the receiving opening 61 is positioned further in the frontward direction than the first opening 131, the first opening 131 is positioned further in the frontward direction than the first opening 141, and the first opening 141 is positioned further in the frontward direction than the atmosphere communication opening 106.

A position in the up-down direction 7 of the receiving opening 61 of the first storage chamber 53 corresponds to a position in the up-down direction 7 (hereinafter, called "the communication position in the up-down direction 7") at which the first storage chamber 53 and the liquid passage 103 are communicated with each other. A direction directed in the rearward direction from the receiving opening 61 denotes a direction away from the first storage chamber 53.

[Atmosphere Communication Portion 70]

As illustrated in FIGS. 5, 11, and 12, the atmosphere communication portion 70 includes a buffer tank 90, four communication passages 145, and an atmosphere communication passage 147.

[Buffer Tank 90]

As illustrated in FIGS. 5 and 11, the buffer tank 90 is positioned below the accommodation case 71 and above the sub tank 100. The buffer tank 90 has an upper wall 91, a lower wall 92, two side walls 93, three partition walls 94, a rear wall 95, and a protruded wall 96.

The upper wall 91 expands along a plane inclined relative to the horizontal plane. The lower wall 92 has a first wall and a second wall. The first wall extends in the front-rear direction 8 in parallel to the horizontal plane. The second wall extends from the front end of the first part and is curved to have an approximately arc shape which is convex frontward and diagonally below. The front end portion of the lower wall 92 (i.e., the front end portion of the second wall) is connected to the front end portion of the upper wall 91.

One of the two side walls 93 connects one end edge in the left-right direction 9 of the upper wall 91 and one end edge in the left-right direction 9 of the lower wall 92 in the up-down direction 7. The remaining one of the two side walls 93 connects the other end edge in the left-right direction 9 of the upper wall 91 and the other end edge in the left-right direction 9 of the lower wall 92 in the up-down direction 7.

The three partition walls 94 are parallel to the two side walls 93 and arranged in the left-right direction 9. The rear wall 95 connects the rear end portion of the upper wall 91 and the rear end portion of the lower wall 92. The protruded wall 96 extends in the upward direction from the rear end portion of the upper wall 91. A gap in the front-rear direction 8 is formed between the protruded wall 96 and the rear wall 95.

[Buffer Chamber 97]

An interior space defined by the upper wall 91, the lower wall 92, the two side walls 93, and the rear wall 95 is partitioned by the three partition walls 94 into four buffer chambers 97. Each of the four buffer chambers 97 is connected to and in communication with the corresponding sub tank 100. Each of the four buffer chambers 97 is a space capable of storing air. As the ink in the first storage chamber 53 is supplied to the second storage chamber 105 through gas-liquid replacement, an air is sent to the buffer chamber 97. The four buffer chambers 97 are positioned above the recording portion 24.

As illustrated in FIG. 5, each of the buffer chambers 97 is positioned below the first storage chamber 53 and above the second storage chamber 105. A portion of the first storage chamber 53 which portion is defined in the protruding portion 65 and a portion of the buffer chamber 97 are positioned on an axis extending in the front-rear direction 8. Further, a portion of the protruding portion 65, a portion of the joint 102, and a portion of the buffer tank 90 are positioned on an axis extending in the front-rear direction 8. Further, a portion of the first storage chamber 53 and a portion of each of the buffer chambers 97 are positioned on an axis extending in the up-down direction 7.

[Communication Passage 145]

Figure 12A:
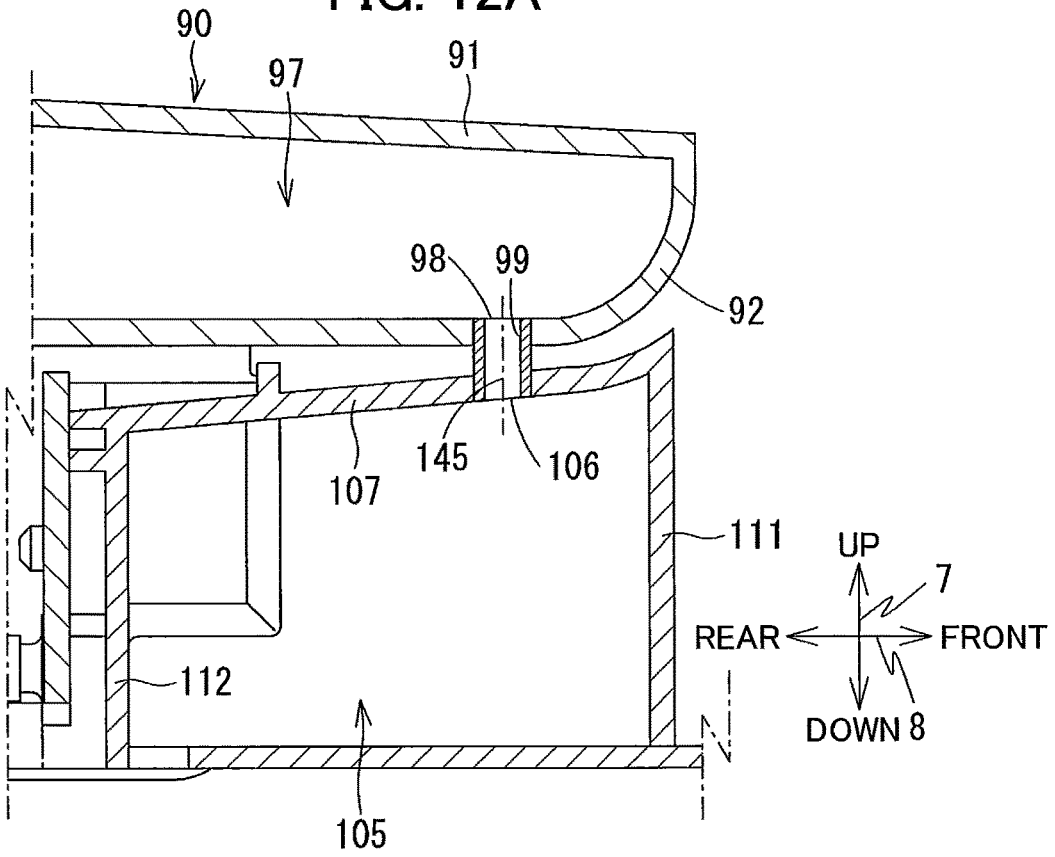
FIG. 12A is a cross-sectional view taken along a line XIIA-XIIA depicted in FIG. 10.

As illustrated in FIG. 12A, the lower wall 92 of the buffer tank 90 is formed with four openings 98 for the four buffer chambers 97. Each of the four openings 98 is in communication with the corresponding buffer chamber 97. The ink supplying device 15 includes four connecting tubes 99. Each of the connecting tubes 99 connects the corresponding atmosphere communication opening 106 of the tank body 101 and the corresponding opening 98 of the buffer tank 90. Each of the connecting tubes 99 has a cylindrical shape. An inner surface of each of the connecting tubes 99 defines the communication passage 145. Each of the buffer chambers 97 is connected to and communicated with the corresponding second storage chamber 105 by the corresponding communication passage 145. The communication passage 145 extends in the up-down direction 7.

[Atmosphere Communication Passage 147]

Figure 12B:
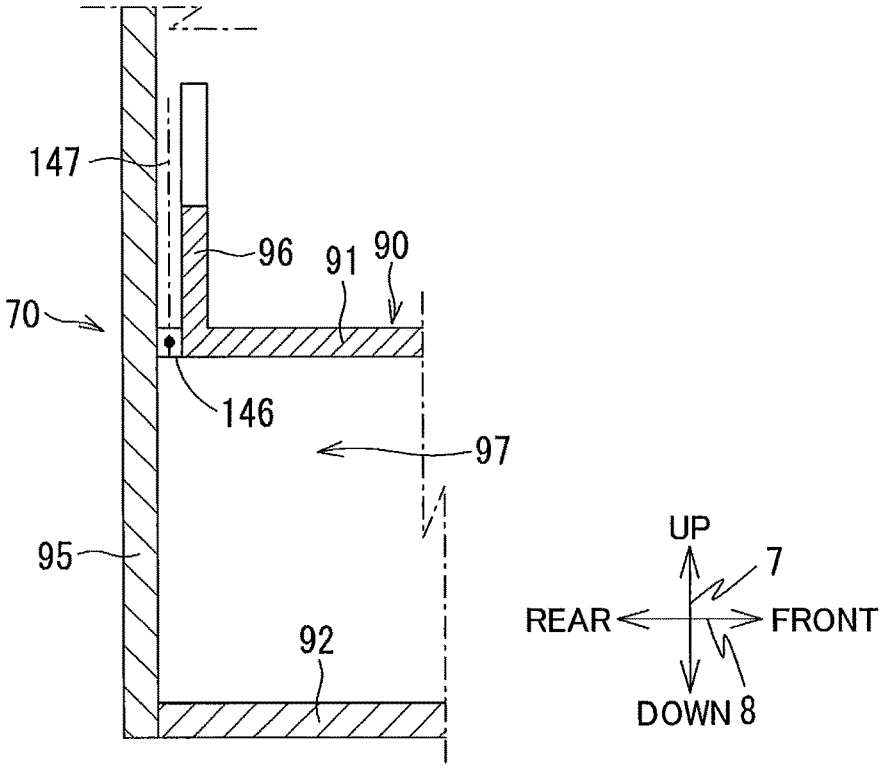
FIG. 12B is a cross-sectional view taken along a line XIIB-XIIB depicted in FIG. 11.

As illustrated in FIG. 12B, the rear end portion of the upper wall 91 is formed with four openings 146 for the four buffer chambers 97. That is, one opening 146 is formed for each of the four buffer chambers 97. At the upper wall 91, the four openings 146 are positioned rearward of the protruded wall 96. The lower surface of the upper wall 91 is inclined upward toward an opposite side (rearward) to the opening portion 98 in the front-rear direction 8. In other words, the lower surface of the upper wall 91 is inclined relative to the horizontal plane such that the rear end of the lower surface is further in the upward direction than the front end of the lower surface.

The four openings 146 are open at a portion of the upper wall 91, at which the highest part in the up-down direction 7 of the entire lower surface of the upper wall 91 is defined. In other words, the four openings 146 are formed at the highest portion of the upper wall 91. The front surface of the rear wall 95 and the rear surface of the protruded wall 96 define the atmosphere communication passage 147 extending in the up-down direction 7. The atmosphere communication passage 147 extends in the upward direction from the buffer chambers 97 via the four openings 146 to be in communication with the atmosphere, i.e., the outside of the housing 14 of the MFP 10.

[Joint 102]

As illustrated in FIGS. 6 and 7, the joint 102 includes the joint body 118, an inner wall 119, a plug member 120, a first sealing member 201, a spring 121, and a sliding member 203.

[Joint Body 118]

As illustrated in FIG. 7, the joint body 118 extends in the front-rear direction 8 and has an outer cylinder portion 122, a tip portion 123, and a main body portion 124. The outer cylinder portion 122 constitutes the rear end portion of the joint body 118. The tip portion 123 constitutes the front end portion of the joint body 118. The main body portion 124 constitutes the middle portion in the front-rear direction 8 of the joint body 118. That is, the main body portion 124 extends in the frontward direction from the front end of the outer cylinder portion 122 to the tip portion 123. The joint body 118 is an example of the ink supply member of the present disclosure. The outer cylinder portion 122, the tip portion 123, and the main body portion 124 are an example of the cylinder part of the present disclosure.

The outer cylinder portion 122 has a cylindrical shape extending in the front-rear direction 8. The tip portion 123 has a disk shape whose center axis extends in the front-rear direction 8. The main body portion 124 has a cylindrical shape extending in the front-rear direction 8.

The joint body 118 is formed with an upper opening 125 and a lower opening 126. The upper opening 125 is an opening for communicating the gas passage 104 with the outside of the cartridge-attachment portion 80. The lower opening 126 is an opening for communicating the liquid passage 103 with the outside of the cartridge-attachment portion 80. The upper opening 125 and the lower opening 126 are formed at the outer peripheral surface of the joint body 118. More specifically, the upper opening 125 and the lower opening 126 are formed at the front end portion of the main body portion 124 and positioned further in the rearward direction than the tip portion 123. The upper opening 125 opens in the upward direction and the lower opening 126 opens in the downward direction. The lower opening 126 is an example of the inlet opening of the present disclosure. The outer peripheral surface of the joint body 118 is an example of the outer circumferential surface of the cylinder portion of the present disclosure.

[Inner Wall 119]

Figure 8:
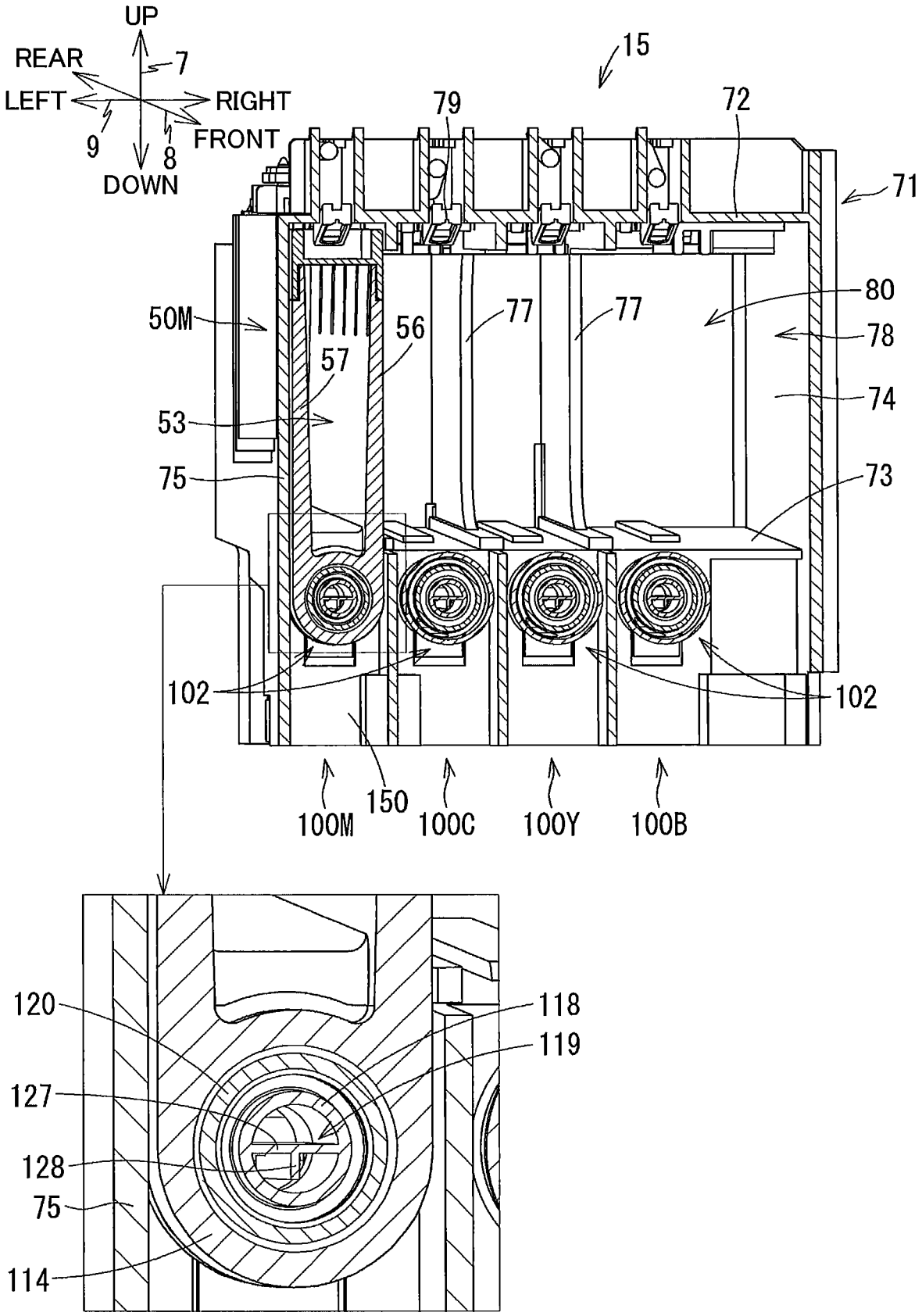
FIG. 8 is a cross-sectional view taken along a line VIII-VIII depicted in FIG. 4.

As illustrated in FIGS. 6 and 7, the inner wall 119 is fixed inside the joint body 118 and formed integrally with the tip portion 123. As illustrated in FIG. 8, the inner wall 119 has a T-shape when viewed in the front-rear direction 8. The inner wall 119 extends in the rearward direction from the tip portion 123 of the joint body 118 to partition an interior space of the joint body 118 into the liquid passage 103 and the gas passage 104. The inner wall 119 has a partition wall 127 and a second rib 128 (see FIGS. 7 and 8). The inner wall 119 is an example of the passage-partition member of the present disclosure.

The partition wall 127 extends in the rearward direction from the tip portion 123 and expands in the left-right direction 9 inside the joint body 118. The rear end surface of the partition wall 127 is in contact with the front end surface of the horizontal wall 116 of the tank body 101. An interior space of a joining portion of the joint body 118 and the tank body 101 is partitioned by both of the partition wall 127 and the horizontal wall 116 into the liquid passage 103 and the gas passage 104.

The second rib 128 protrudes in the downward direction from the center portion in the left-right direction 9 of the partition wall 127. Further, the second rib 128 extends in the rearward direction from the tip portion 123. A gap is formed between the second rib 128 and the inner surface of the joint body 118.

The joint-side part of the horizontal passage 134 of the liquid passage 103 is defined by the inner surface of the joint body 118 and the lower surface of the inner wall 119. A cross section of the joint-side part of the horizontal passage 134 has an approximately semi-circular shape. More specifically, in the cross section of the joint-side part of the horizontal passage 134, the upper portion of the semi-circular shape is divided by the second rib 128 into left and right portions, whereas the lower portion of the semi-circular shape is not divided into left and right portions (i.e., the right and left portions of the lower portion of the semi-circular shape are continuous).

The joint-side part of the horizontal passage 144 of the gas passage 104 is defined by the inner surface of the joint body 118 and the upper surface of the inner wall 119. A cross section of the joint-side part of the horizontal passage 144 has a semi-circular shape.

[Attached State of Ink Cartridge 50]

As illustrated in FIGS. 5 and 7, in the attached state of the ink cartridge 50 to the cartridge-attaching portion 80, the ink cartridge 50 is accommodated in the accommodation case 71, the joint body 118 of the joint 102 extends through the receiving opening 61, the front portion of the joint body 118 is inserted in the lower-front portion of the first storage chamber 53 (i.e., the joint receiving portion 52), and the second opening 132 of the liquid passage 103 and the second opening 142 of the gas passage 104 are positioned inside the first storage chamber 53. Further, in this attached state, the upper opening 125 and the lower opening 126 are opened and positioned in the first storage chamber 53, the liquid passage 103 and the gas passage 104 are in communication with the first storage chamber 53 through the lower opening 126 and the upper opening 125, respectively, and the ink accommodated in the first storage chamber 53 is supplied to the recording head 39 through at least the liquid passage 103.

[Plug Member 120]

As illustrated in FIGS. 7, 8, and 9, the plug member 120 has a cylindrical shape extending in the front-rear direction 8. More specifically, the plug member 120 has an annular shape surrounding the outer peripheral surface of the joint body 118. The plug member 120 is positioned outward of the joint 118 with the joint body 118 inserted through the plug member 120.

The plug member 120 is slidably movable on the outer peripheral surface of the joint body 118 between a second closed position illustrated in FIG. 6 and a second open position illustrated in FIGS. 5 and 7. In the second closed position, as illustrated in FIG. 6, the plug member 120 closes the lower opening 126 to interrupt a communication between the liquid passage 103 and the outside of the cartridge-attachment portion 80. In the present embodiment, the plug member 120 in the second closed position closes not only the lower opening 126 but also the upper opening 125. In the second open position, as illustrated in FIG. 7, the plug member 120 opens the lower opening 126 to allow the communication between the liquid passage 103 and the outside of the cartridge-attachment portion 80. In the present embodiment, the plug member 120 in the second open position opens not only the lower opening 126 but also the upper opening 125. In this way, the plug member 120 serves as a valve opening and closing the lower opening 126. The plug member 120 is an example of the second valve of the present disclosure. The second closed position is an example of the third position of the present disclosure. The second open position is an example of the fourth position of the present disclosure.

The spring 121 is provided rearward of the plug member 120. The front end portion of the spring 121 is in contact with the rear end portion of the plug member 120. The spring 121 can be compressed in the front-rear direction 8. The spring 121 urges, with its elastic force, the plug member 120 in the frontward direction. That is, the spring 121 urges the plug member 120 from the second open position toward the second closed position. The spring 121 is an example of the second urging member of the present disclosure.

As illustrated in FIG. 6, while no external force is applied to the plug member 120, the plug member 120 is positioned in the second closed position and is in contact with the first sealing member 201 by the urging force (elastic force) in the frontward direction of the spring 121. In this state, as described above, the upper opening 125 and the lower opening 126 are closed by the plug member 120.

On the other hand, as illustrated in FIGS. 5 and 7, when an external force in the rearward direction that is greater than the urging force (elastic force) of the spring 121 is applied to the plug member 120, the plug member 120 is slid in the rearward direction, on the outer peripheral surface of the joint body 118, from the second closed position to the second open position against the urging force of the spring 121. As a result, the upper opening 125 and the lower opening 126 are opened as illustrated in FIG. 7.

As illustrated in FIGS. 6 and 7, the plug member 120 includes a first part 120*a* and a second part 120*b* integrally formed with the first part 120*a*. The plug member 120 has a sliding surface 120*c* (FIG. 7) and a surface 120*d* (FIG. 6).

As illustrated in FIG. 6, in the separated state, i.e., in a state in which the plug member 120 is in the second closed position, the first part 120*a* is in contact with the first sealing member 201 to close the upper opening 125 and the lower opening 126. The second part 120*b* protrudes in the up-down direction 7 from the first part 120*a*. In other words, the second part 120*b* is positioned farther from the outer peripheral surface of the joint body 118 in a radial direction of the main body portion 124 of the joint body 118 (i.e., a direction orthogonal to the front-rear direction 8) than the first part 120*a* is from the outer circumferential surface in the radial direction. Each of the radial direction, the up-down direction 7, and the left-right direction 9 is an example of the third direction of the present disclosure.

As illustrated in FIG. 7, the sliding surface 120*c* constitutes the inner circumferential surface of the plug member 120. The sliding surface 120*c* is in contact with the outer peripheral surface of the joint body 118. In a case in which the plug member 120 moves in the front-rear direction 8, the plug member 120 moves while sliding the sliding surface 120*c* on the outer peripheral surface of the joint body 118. That is, the sliding surface 120*c* is in sliding contact with the outer peripheral surface of the joint body 118 and thus the plug member 120 is slidable on the outer peripheral surface of the joint body 118 between the second closed position and the second open position. As illustrated in FIG. 6, the surface 120*d* constitutes the front surface of the plug member 120 (i.e., the front surface of the first part 120*a*). The surface 120*d* faces in the frontward direction and has an annular shape when viewed from the front. The surface 120*d* is an example of the third contact surface of the present disclosure. The sliding surface 120*c* is an example of the inner circumferential surface of the second valve of the present disclosure.

[First Sealing Member 201]

As illustrated in FIGS. 6 and 7, the first sealing member 201 is provided at the front end of the joint body 118. The first sealing member 201 is made of elastic material, such as rubber. As illustrated in FIG. 11, the first sealing member 201 has a circular shape when viewed in the front-rear direction 8. The first sealing member 201 is fixed to the tip portion 123 of the joint body 118. The first sealing member 201 has a surface 201*a* and a surface 201*b*. As illustrated in FIG. 6, the surface 201*a* constitutes the rear surface of the first sealing member 201 and faces in the rearward direction. The surface 201*b* constitutes the front surface of the first sealing member 201 and faces in the frontward direction. The first sealing member 201 is an example of the second pressing member of the present disclosure. The surface 201*a* is an example of the second contact surface of the present disclosure. The surface 201*b* is an example of the second pressing surface of the present disclosure. The front end of the joint body 118 is an example of the protruding end of the cylinder part of the present disclosure.

As illustrated in FIG. 6, in the separated state in which the ink cartridge 50 is not attached to the cartridge-attaching portion 80, the plug member 120 is in the second closed position and the surface 201*a* of the first sealing member 201 is in contact with the surface 120*d* of the first part 120*a* of the plug member 120. By this contact between the surface 201*a* and the surface 120*d* of the first part 120*a*, the upper opening 125 and the lower opening 126 are closed and thus not in communication with the outside of the cartridge-attachment portion 80. Further, by the contact between the surface 201*a* and the plug member 120 that is in the second closed position, the plug member 120 is prevented from further moving in the frontward direction (i.e., in a direction in which the spring 121 urges the plug member 121 that is in the second closed position) from the second closed position.

The plug member 120 is urged in the frontward direction by the spring 121. Therefore, in the separated state illustrated in FIG. 6, the plug member 120 is pressed by the spring 121 toward the first sealing member 201 and thus the first sealing member 201 is pressed by the plug member 120 to be elastically deformed. Accordingly, in the separated state, the plug member 120 and the first sealing member 201 are in contact with each other with a strong sealing pressure, thereby reliably sealing the interior space of the joint body 118. With this configuration, not only in the attachment process but also in the detachment process, ink remained in the interior space of the joint body 118 can be suppressed from leaking out of the joint body 118 via the upper opening 125 and the lower opening 126.

Sealing pressure between two members when one of the two members is made of elastic material but the remaining one is made of non-elastic material is greater than that when both of the two members are made of elastic material. Taking the above into account, it is preferable that the plug member 120 be made of non-elastic material in order to increase the sealing pressure between the plug member 120 and the first sealing member 201. However, the plug member 120 may be made of elastic material, similarly to the first sealing member 201. Further, although the first sealing member 201 configured to come into contact with the plug member 120 is made of elastic material in the present embodiment, the first sealing member 201 may be made of non-elastic material. That is, the first sealing member 201 and plug member 120 may be made of any material. For example, the plug member 120 may be made of elastic material, whereas the first sealing member 201 may be made of non-elastic material.

[Second Sealing Member 202]

As illustrated in FIGS. 6 and 7, the ink cartridge 50 is provided with the second sealing member 202. The second sealing member 202 has a cylindrical shape extending in the front-rear direction 8. More specifically, the second sealing member 202 has an annular shape surrounding the receiving opening 61. The second sealing member 202 is made of elastic material, such as rubber. The second sealing member 202 is fixed to the inner surface of the joint receiving portion 52. The second sealing member 202 is positioned further in the rearward direction than the plug member 62. The second sealing member 202 has an inner diameter greater than diameters of the first sealing member 201 and the joint body 118. With the configuration, in the attachment process, the first sealing member 201 can pass through the second sealing member 202 and the joint body 118 can be inserted through the second sealing member 202. The second sealing member 202 is an example of the first pressing member of the present disclosure.

As illustrated in FIG. 6, the second sealing member 202 has a tapered surface 202*a*. The tapered surface 202*a* is defined at the rear end portion of the second sealing member 202 and connected to the rear end surface thereof. The tapered surface 202*a* has an annular shape with a prescribed width in the radial direction when viewed from the rear. The tapered surface 202*a* is inclined relative to the center axis of the second sealing member 202 such that a circle defined by the front end edge of the tapered surface 202*a* is positioned further inward in the radial direction than a circle defined by the rear end edge of the tapered surface 202*a*. The tapered surface 202*a* is an example of the first pressing surface of the present disclosure.

As illustrated in FIG. 7, in the attached state, the plug member 120 is in the second open position and the tapered surface 202*a* of the second sealing member 202 is in contact with the front surface of the second part 120*b* of the plug member 120.

The plug member 120 is urged in the frontward direction by the spring 121. Therefore, in the attached state illustrated in FIG. 7, the second part 120*b* of the plug member 120 is pressed by the spring 121 against the tapered surface 202*a* of the second sealing member 202 and thus the second sealing member 202 is pressed by the plug member 120 to be elastically deformed. Accordingly, in the attached state, the plug member 120 and the second sealing member 202 are in contact with each other with a strong sealing pressure, thereby suppressing ink from leaking out during the attachment process.

[Sliding Member 203]

As illustrated in FIGS. 6 and 7, the sliding member 203 is provided further in the rearward direction than the plug member 120. The sliding member 203 has a cylindrical shape and is made of elastic material, such as rubber. More specifically, the sliding member 203 is formed in an annular shape surrounding the outer peripheral surface of the joint body 118. The sliding member 203 is fixed to the plug member 120 and the joint body 118 is inserted through the sliding member 203. Thus, the sliding member 203 is slidable on the outer peripheral surface of the joint body 118 together with the plug member 120. The sliding member 203 is an example of the slide member of the present disclosure.

In the attachment process and the detachment process, the sliding member 203 slidingly moves on the outer peripheral surface of the joint body 118 in the front-rear direction 8 together with the plug member 120 during sliding movement of the plug member 120 in the front-rear direction 8 between the second closed position and the second open position. Further, the sliding member 203 is always in close contact with the outer peripheral surface of the joint body 118, thereby suppressing ink from leaking out via a gap between the inner circumferential surface of the plug member 120 and the outer peripheral surface of the joint body 118.

[Third Sealing Member 204]

As illustrated in FIG. 7, the third sealing member 204 is made of elastic material, such as rubber. The third sealing member 204 is formed in an annular shape surrounding the receiving opening 61. The third sealing member 204 further has a surface 204*b*. The surface 204*b* constitutes the rear surface of the third sealing member 204 and faces in the rearward direction. The third sealing member 204 is an example of the third pressing member of the present disclosure. The surface 204*b* is an example of the third pressing surface of the present disclosure.

In the attached state, as illustrated in FIG. 7, the surface 204*b* is in contact with the surface 120*d* of the first part 120*a* of the plug member 120. The plug member 120 is urged in the frontward direction by the spring 121. Therefore, in the attached state, the surface 120*d* of the plug member 120 is pressed against the surface 204*b* of the third sealing member 204 by the spring 121 and thus the third sealing member 204 is elastically deformed. Accordingly, in the attached state, the plug member 120 and the third sealing member 204 are in contact with each other with a strong sealing pressure, thereby suppressing ink from leaking out during the attachment process.

[Attachment Process of Ink Cartridge 50]

The attachment process of the ink cartridge 50 to the cartridge-attachment portion 80 whose sub tanks 100 are empty will be described.

When the ink cartridge 50 has not been attached to the cartridge-attachment portion 80, that is, when the ink cartridge 50 is in the separated state illustrated in FIG. 6, the ink cartridge 50 is separated from the cartridge-attachment portion 80, the plug member 62 is in the first closed position, and the plug member 120 is in the second closed position. In the separated state, the receiving opening 61 of the ink cartridge 50 is closed by the plug member 62 and the third sealing member 204 and is not communication with ink storage chamber 53. Accordingly, in the separated state, the ink stored in the ink storage chamber 53 does not leak out via the receiving opening 61. In the separated state, the upper opening 125 and the lower opening 126 of the cartridge-attaching portion 80 are closed by the first part 120*a* of the plug member 120.

Figure 13A:
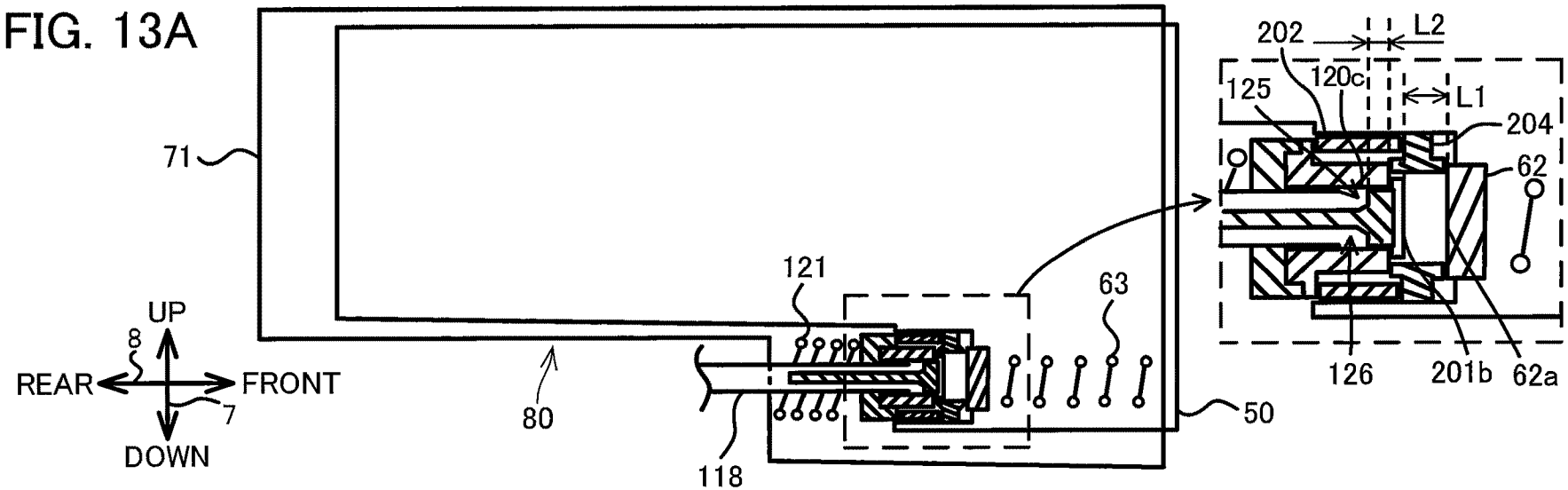
FIG. 13A is a view schematically illustrating the ink cartridge and the cartridge-attachment portion of the MFP according to the embodiment in an attachment process of attaching the ink cartridge to the cartridge-attachment portion.
Figure 13B:
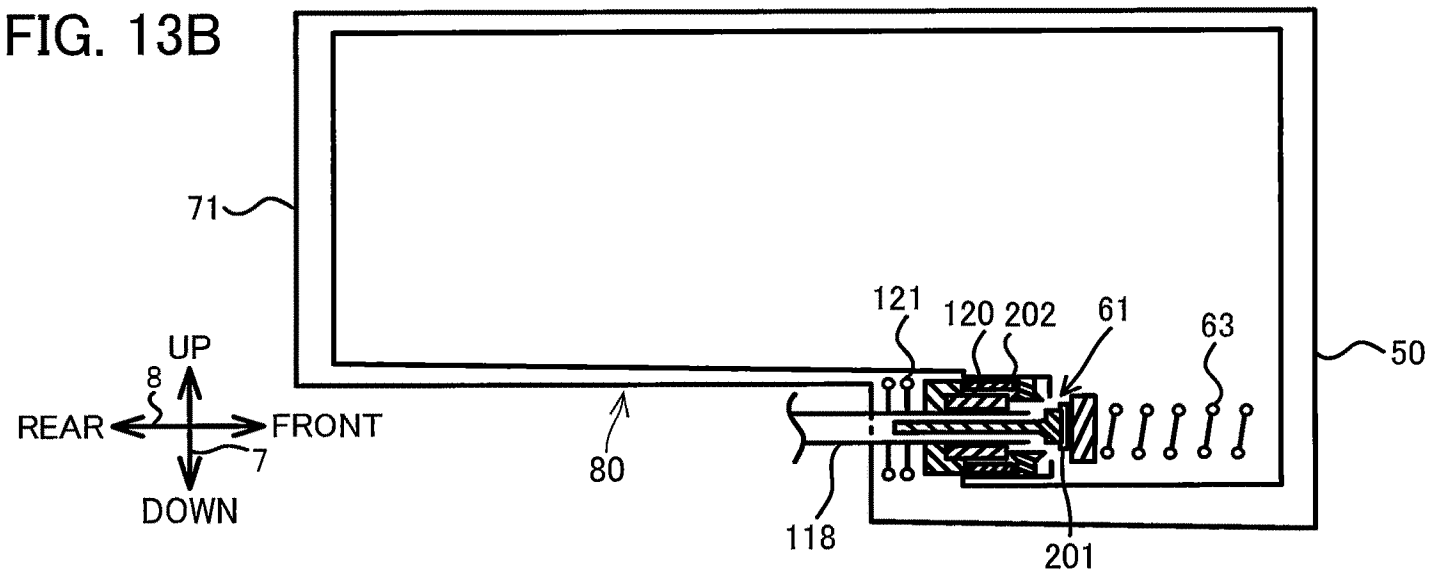
FIG. 13B is a view schematically illustrating the ink cartridge and the cartridge-attachment portion of the MFP according to the embodiment in the attached state.

FIG. 13A is a view schematically illustrating a state when the ink cartridge 50 is about to be attached to the cartridge-attachment portion 80. Specifically, the view illustrates a moment when the tapered surface 202*a* of the second sealing member 202 and the surface 204*b* of the third sealing member 204 come into contact with the front surface of the second part 120*b* and the surface 120*d* of the first part 120*a*, respectively. FIG. 13B is a view schematically illustrating a state when the attachment of the ink cartridge 50 to the cartridge-attaching portion 80 has been completed.

In the present embodiment, as illustrated in FIG. 13A, a distance L1 is greater than a distance L2 (L1>L2) at the moment when the second sealing member 202 and the third sealing member 204 come into contact with the second part 120*b* and the first part 120*a*, respectively.

The distance L1 represents a distance in the front-rear direction 8 between the surface 201*b* of the first sealing member 201 and the surface 62*a* of the plug member 62. The distance L2 represents a distance in the front-rear direction 8 between the front end edge of the sliding surface 120*c* of the plug member 120 and the front end of the lower opening 126. The front end edge of the sliding surface 120*c* is an example of the one end edge of the inner circumferential surface of the present disclosure. The front end of the lower opening 126 is an example of the one end of the inlet opening of the present disclosure. The distance L1 is an example of the first distance of the present disclosure. The distance L2 is an example of the second distance of the present disclosure.

Further, a position in the front-rear direction 8 of the front end of the upper opening 125 is the same as a position in the front-rear direction 8 of the front end of the lower opening 126. In other words, the front end of the upper opening 125 and the front end of the lower opening 126 are aligned in the up-down direction 7. Therefore, at the moment illustrated in FIG. 13A, a distance in the front-rear direction 8 between the front end edge of the sliding surface 120*c* and the front end of the upper opening 125 is equal to the distance L2.

With the above configuration, in the attachment process, the upper opening 125 and the lower opening 126 are opened before the plug member 62 comes into contact with the first sealing member 201.

Further, after the tapered surface 202*a* and the surface 204*b* contacts the front surface of the second part 120*b* and the surface 120*d*, respectively, the contact between the tapered surface 202*a* and the front surface of the second part 120*b* and the contact between the surface 204*b* and the surface 120*d* are maintained to thereby seal the receiving opening 61 in the attachment process.

When the ink cartridge 50 is further pressed rearward (i.e., further inserted into the cartridge-attachment portion 80 in the rearward direction) from the state illustrated in FIG. 13A, the tapered surface 202*a* of the second sealing member 202 and the surface 204*b* of the third sealing member 204 start to press and move the plug member 120 from the second closed position toward the second open position (i.e., in the rearward direction) against the urging force of the spring 121. After then, the side surface 62*a* of the plug member 62 that is in the first closed position closing the receiving opening 61 comes into contact with the surface 201*b* of the first sealing member 201 of the cartridge-attaching portion 80.

When the ink cartridge 50 is further pressed rearward after the side surface 62*a* of the plug member 62 comes into contact with the surface 201*b* of the first sealing member 201, the surface 201*b* of the first sealing member 201 starts to press and move the plug member 62 from the first closed position toward the first open position (i.e., in the frontward direction relative to the accommodation case 71) against the urging force of the spring 63. Further, at this time, the front portion of the joint body 118 starts to be inserted into the first storage chamber 53 through the receiving opening 61.

After then, when ink cartridge 50 is further inserted rearward, the tapered surface 202*a* and the surface 204*b* press and move the plug member 120 up to the second open position, the surface 201*b* presses and moves the plug member 62 up to the first open position, the front portion of the joint body 118 is inserted in the first storage chamber 53. As a result, the receiving opening 61 is opened (see FIG. 13B) and thus the first storage chamber 53 comes into communication with the second storage chamber 105 via the liquid passage 103 and the gas passage 104, whereby the attachment of the ink cartridge 50 to the cartridge-attachment portion 80 is completed.

As described above, in the attached state, the plug member 62 and the plug member 120 are positioned in the first open position and the second open position, respectively. Further, in the attached state, the lower opening 126 is opened and positioned in the first storage chamber 53 and the liquid passage 103 is in communication with the first storage chamber 53 through the lower opening 126.

It is preferable that, in the attachment process, the receiving opening 61 of the ink cartridge 50 is opened after the upper opening 125 and the lower opening 126 are opened. Assuming that the upper opening 125 and the lower opening 126 are opened after the receiving opening 61 is opened, the ink in the ink storage chamber 53 cannot flow into the liquid passage 103 and thus the ink may leak out. In the present embodiment, the upper opening 125 and the lower opening 126 are opened before the receiving opening 61 is opened. This opening order can suppress ink from leaking out in the attachment process of the ink cartridge 50 to the cartridge-attachment portion 80.

When the first storage chamber 53 comes into communication with the second storage chamber 105, the ink in the first storage chamber 53 of the ink cartridge 50 naturally drops and enters the second storage chamber 105 of the sub tank 100 via the liquid passage 103. Note that, since the atmosphere communication opening 106 is in communication with the atmosphere (the outside air), air of the same volume as the volume of the ink that has entered the second storage chamber 105 enters the first storage chamber 53 via the atmosphere communication opening 106 and the gas passage 104. In this way, the ink in the first storage chamber 53 is replaced with air (gas-liquid replacement) and thus the ink in the first storage chamber 53 is supplied to the second storage chamber 105.

As gas-liquid replacement advances, a level of the ink in the second storage chamber 105 rises. When the level of the ink rises and reaches the lower end of the vertical wall 115, the first opening 141 of the gas passage 104 is closed, thereby resulting in stoppage of the gas-liquid replacement. As a result, supply of the ink from the first storage chamber 53 to the second storage chamber 105 stops. In this way, an initial introduction of the ink from the first storage chamber 53 into the second storage chamber 105 is performed.

In the present embodiment, the plug member 62 configured to open and close the receiving opening 61 is pressed by first sealing member 201, thereby causing the plug member 62 to open the receiving opening 61. Further, the plug member 120 configured to open and close both of the upper opening 125 and the lower opening 126 is pressed by both of the second sealing member 202 and the third sealing member 204, thereby causing the plug member 120 to open both of the upper opening 125 and the lower opening 126.

Further, in the present embodiment, the first sealing member 201 is assembled to the joint body 118 fixed to the tank body 101. The second sealing member 202 and the third sealing member 204 are fixed to the joint receiving portion 52. That is, the plug member 62 comes into contact with the fixed member (i.e., the fixed first sealing member 201) and the plug member 120 comes into contact with the fixed members (i.e., the fixed second sealing member 202 and the fixed third sealing member 204), thereby opening the receiving opening 61, the upper opening 125, and the lower opening 126.

With the above configuration, an opening order of the receiving opening 61, the upper opening 125, and the lower opening 126 can be securely controlled. Therefore, the ink cartridge 50 can be attached to the cartridge-attachment portion 80 with the above-described opening order in which the upper opening 125 and the lower opening 126 are first opened and then the receiving opening 61 is opened. Accordingly, the receiving opening 61 can be prevented from being opened before the upper opening 125 and the lower opening 126 are opened, thereby suppressing the ink in the first storage chamber 53 from leaking out during the attachment process.

In the present embodiment, the first sealing member 201 is provided at the frontward end of the joint body 118, and the plug member 120 has the cylindrical shape and is slidable on the outer peripheral surface of the joint body 118. Further, the second sealing member 202 and the third sealing member 204 configured to press the plug member 120 in the attachment process have the cylindrical shapes allowing the joint body 118 to be inserted into the second sealing member 202 and the third sealing member 204.

With the above configuration, despite the fact that the two plug members 62 and 120 are disposed on the same axis extending in the front-rear direction 8, the upper opening 125, the lower opening 126, and the receiving opening 61 can be opened and closed without allowing the two plug members 62 and 120 to push each other. Accordingly, the upper opening 125, the lower opening 126, and the receiving opening 61 can be opened in a desired opening order while suppressing an increase in the size of the MFP 10.

Next, a detailed description will be made regarding how ink and air flow when a recording operation is executed by the printer portion 11 in the attached state.

When ink droplets are ejected from the recording head 39 in the recording operation, the ink in the second storage chamber 105 is sucked to the recording head 39 via the communication opening 129 and reduces. As the ink in the second storage chamber 105 reduces, a level of the ink in the second storage chamber 105 lowers, thereby causing the closed first opening 141 of the gas passage 104 to be opened.

When the first opening 141 of the gas passage 104 is opened, the above-described gas-liquid replacement takes place and thus the ink is supplied from the first storage chamber 53 to the second storage chamber 105. That is, the ink is supplied from the first storage chamber 53 to the second storage chamber 105 to compensate the ink consumption in the recording head 39. In this way, the ink cartridge 50 supplies ink to the recording head 39. Therefore, the level of the ink in the second storage chamber 105 is maintained at a height of the first opening 141 of the gas passage 104.

Note that, even when the ink in the first storage chamber 53 is fully consumed, a user can have the MFP 10 continuously perform the recording operations by replacing the empty ink cartridge 50 with a new ink cartridge 50 fully filled with ink.

[Technical Advantages]

In the above-described MFP 10 according to the present embodiment of the present disclosure, in the attachment process, the tapered surface 202*a* of the second sealing member 202 of the ink cartridge 50 presses the plug member 120 to open the lower opening 126 and the surface 201*b* presses the plug member 62 to open the receiving opening 61. With this configuration, in comparison with a configuration in which a plug member and a plug member press each other to open the lower opening and a receiving opening, the lower opening 126 and the receiving opening 61 can be opened reliably in a desired opening order. Accordingly, the ink in the first storage chamber 53 can be suppressed from leaking out in the attachment process.

In the MFP 10 according to the present embodiment, the surface 201*b* configured to press the plug member 62 is defined at the extending end portion (i.e., front end portion) of the joint body 118 and the plug member 120 configured to open and close the lower opening 126 has an annular shape and is slidable on the outer peripheral surface of the joint body 118. Further, the tapered surface 202*a* configured to press the plug member 120 has an annular shape allowing the joint body 118 to be inserted therethrough. Accordingly, despite the fact that the two plug members 62 and 120 are disposed on the same axis extending in the front-rear direction 8, the lower opening 126 and the receiving opening 61 can be opened and closed without allowing the two plug members 62 and 120 to push each other. As a result, the lower opening 126 and the receiving opening 61 can be opened in a desired opening order while suppressing an increase in the size of the MFP 10.

Further, since both of the plug member 120 and the tapered surface 202*a* have the annular shape, a space between the plug member 62 and the plug member 120 can be sealed from the outside when the tapered surface 202*a* contacts the second part 120*b* of the plug member 120. This configuration can reduce the possibility that the ink in the first storage chamber 53 leaks out.

In the MFP 10 according to the present embodiment, in the attachment process, the surface 204*b* of the ink cartridge 50 contacts the surface 120*d* of the plug member 120. This configuration can further reliably reduce the risk of the ink leakage.

Further, in the MFP 10 according to the present embodiment, the surface 120*d* of the plug member 120 can contact the surface 204*b* of the ink cartridge 50 and the surface 201*a* of the first sealing member 201. With this configuration, a portion contacting the surface 204*b* and a portion contacting the surface 201*a* are not required to be separately provided at the plug member 120, thereby suppressing an increase in the size of the MFP 10.

Further, in the MFP 10 according to the present embodiment, in the attachment process, the receiving opening 61 of the ink cartridge 50 is opened after the lower opening 126 is opened. Assuming that the lower opening 126 is opened after the receiving opening 61 is opened, the ink in the ink storage chamber 53 cannot flow into the liquid passage 103. In this assumed configuration, the ink accumulates in a space between the plug member 120 and the plug member 62 and may leak out of the first storage chamber 53 to the outside. In the present embodiment, since the lower opening 126 is already opened before the receiving opening 61 is opened, the ink in the first storage chamber 53 can flow into the liquid passage 103 via the lower opening 126 as soon as the receiving opening 61 is opened. With this configuration, the ink does not easily accumulate in the space between the plug member 62 and the plug member 120, thereby suppressing the risk of the ink leakage from the first storage chamber 53 to the outside.

Further, in the MFP 10 according to the present embodiment, since the sliding member 203 is in close contact with the outer peripheral surface of the joint body 118, the space between the plug member 62 and the plug member 120 can be reliably sealed from the outside in the attachment process. This configuration can further suppress the possibility that the ink in the first storage chamber 53 leaks out.

Further, in the MFP 10 according to the present embodiment, the inner wall 119 partitioning the interior space of the joint body 118 into the liquid passage 103 and the gas passage 104 is formed integrally with the tip portion 123 and extends from the same. Accordingly, a member pressing the plug member 62 and a member partitioning the interior space of the joint body 118 into the liquid passage 103 and the gas passage 104 can be formed of a single member, thereby reducing the number of parts constituting the MFP 10 and enabling miniaturization thereof.

As stated above, the MFP 10 according to the present embodiment can stably control the opening order of the receiving opening 61 and the lower opening 126 in the attachment process.

[Modifications]

While the description has been made in detail with reference to the specific embodiment, it would be apparent to those skilled in the art that many modifications and variations may be made thereto. In the following description, of the components and elements in each modification, the components and elements that are identical to those of the above-described embodiment are designated with the same reference numerals to avoid duplicating descriptions, and only the components and elements that differ from those of the above-described embodiment will be described.

Figure 14:
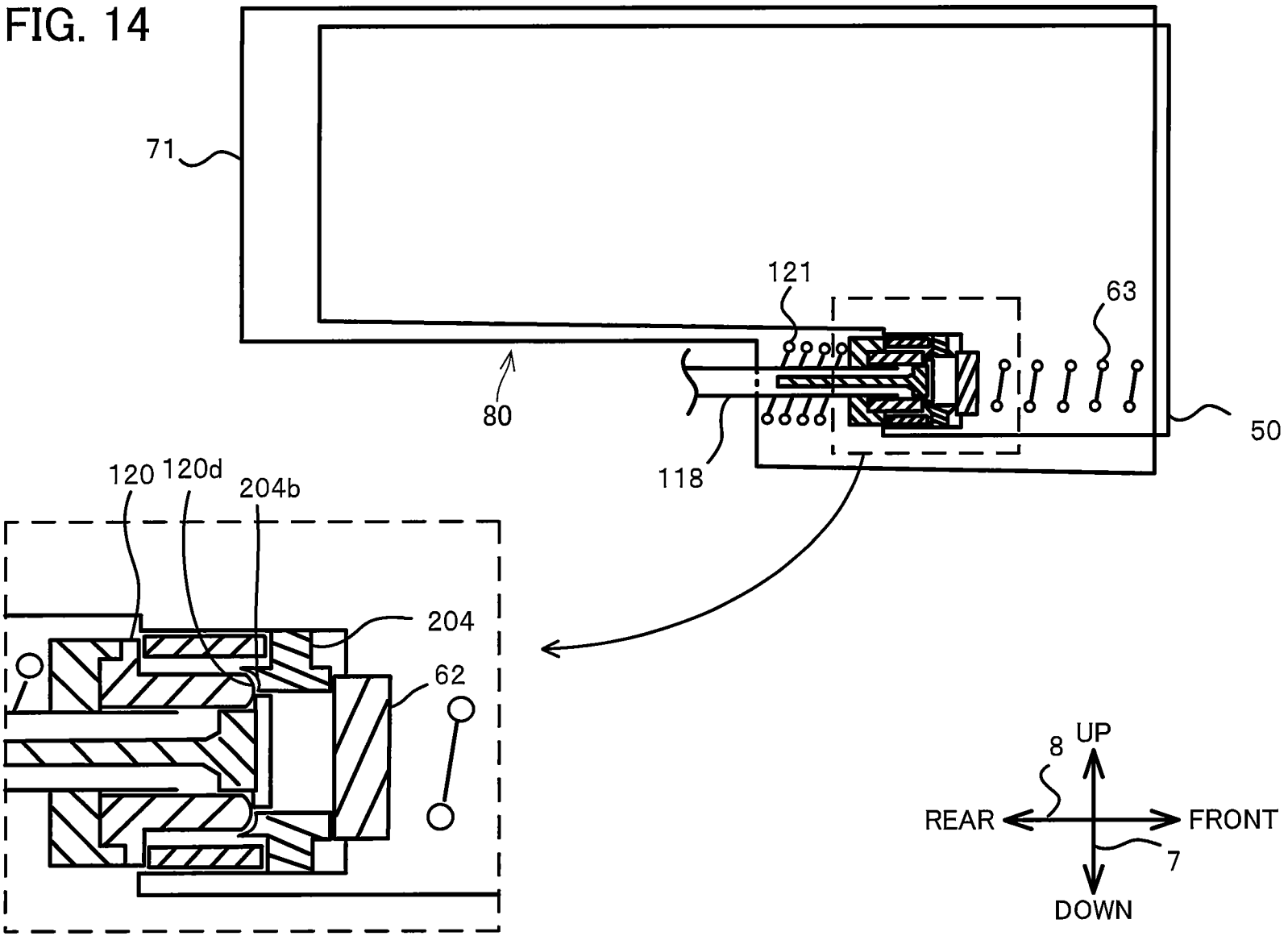
FIG. 14 is a schematic view for describing an MFP according to a modification of the embodiment.

A modification of the present embodiment will be described while referring to FIG. 14. As in the modification illustrated in FIG. 14, the surface 120*d* of the plug member 120 and the surface 204*b* of the third sealing member 204 may be curved. More specifically, in the modification, the surface 120*d* is curved to protrude in the frontward direction when viewed in the left-right direction 9 and the surface 204*b* is curved to be recessed in the frontward direction when viewed in the left-right direction 9, thereby enabling the surface 204*b* and the surface 120*d* to fit to each other.

With the above configuration, even when a posture of the plug member 120 or a posture of the third sealing member 204 is inclined in the attachment process, a contact area of the surface 120*d* and the surface 204*b* can be suppressed from reducing. Therefore, the strong sealing pressure between the plug member 120 and the third sealing member 204 can be kept, thereby further securely suppressing the ink in the first storage chamber 53 from leaking out in the attachment process.

Alternatively, the surface 120*d* may be curved to be recessed in the rearward direction and the surface 204*b* may be curved to protrude in the rearward direction so that the surface 120*d* and the surface 204*b* can fit to each other. However, the surface 120*d* and the surface 204*b* may have any shapes, provided that the surface 120*d* and the surface 204*b* can contact each other in the attachment process.

What is claimed is:

1. An inkjet recording apparatus comprising:

a recording head configured to eject ink;

an ink cartridge configured to supply ink to the recording head, the ink cartridge comprising:

a main body formed with an opening to an outside of the ink cartridge;

an ink chamber accommodating therein ink and disposed in the main body;

a first valve movable between:

a first position closing the opening to interrupt a communication between the ink chamber and the opening; and a second position opening the opening to allow the communication between the ink chamber and the opening;

a first urging member urging the first valve from the second position toward the first position;

a first contact surface in contact with the first valve that is in the first position to prevent the first valve from further moving from the first position in a direction in which the first urging member urges the first valve that is in the first position;

a first pressing member having a first pressing surface;

a cartridge-attachment portion to which the ink cartridge is detachably attachable, the ink cartridge being inserted into the cartridge-attachment portion in a first direction in an attachment process of attaching of the ink cartridge to the cartridge-attachment portion, the cartridge-attachment portion comprising:

an ink supply member extending in a second direction opposite to the first direction, the ink supply member providing therein an ink passage allowing ink to flow therethrough, the ink supply member being formed with an inlet opening for communicating the ink passage with an outside of the cartridge-attachment portion;

a second valve movable between:

a third position closing the inlet opening to interrupt a communication between the ink passage and the outside of the cartridge-attachment portion; and a fourth position opening the inlet opening to allow the communication between the ink passage and the outside of the cartridge-attachment portion;

a second urging member urging the second valve from the fourth position toward the third position;

a second contact surface in contact with the second valve that is in the third position to prevent the second valve from further moving from the third position in a direction in which the second urging member urges the second valve that is in the third position;

a second pressing member having a second pressing surface, wherein, in the attachment process, at least a portion of the ink supply member is inserted into the ink chamber through the opening, the first pressing surface presses the second valve to move the second valve from the third position to the fourth position, the second pressing surface presses the first valve to move the first valve from the first position to the second position, wherein, in an attached state in which the ink cartridge is attached to the cartridge-attachment portion, the inlet opening is opened and positioned in the ink chamber, the ink passage is in communication with the ink chamber through the inlet opening, and the ink accommodated in the ink chamber is supplied to the recording head through the ink passage.

2. The inkjet recording apparatus according to claim 1, wherein the ink supply member comprises a cylinder part extending in the second direction to have an extending end portion, wherein the first pressing member is formed in an annular shape surrounding the opening, wherein the inlet opening is formed at an outer circumferential surface of the cylinder portion, wherein the second pressing member is provided at the extending end portion of the cylinder part, wherein the second valve is formed in an annular shape surrounding the outer circumferential surface and is slidable on the outer circumferential surface in the first direction and the second direction, the second valve moving from the third position to the fourth position by sliding on the outer circumferential surface in the first direction, the second valve moving from the fourth position to the third position by sliding on the outer circumferential surface in the second direction, the second valve comprising a first part and a second part formed integrally with the first part, the first part closing the inlet opening when the second valve is in the third position, the second part being positioned farther from the outer circumferential surface in a third direction orthogonal to the first direction than the first part is from the outer circumferential surface in the third direction, and wherein, in the attachment process, the first pressing surface contacts the second part to seal the opening and presses the second valve in the first direction.

3. The inkjet recording apparatus according to claim 2, wherein the ink cartridge further comprises a third pressing member formed in an annular shape surrounding the opening, the third pressing member having a third pressing surface, wherein the first part of the second valve has a third contact surface contacting the third pressing surface in the attachment process, and wherein, in the attachment process, the third pressing surface contacts the third contact surface to seal the opening and presses the second valve in the first direction.

4. The inkjet recording apparatus according to claim 3, wherein the third contact surface contacts the second contact surface when the second valve is in the third position.

5. The inkjet recording apparatus according to claim 3, wherein the third contact surface is curved to protrude in the second direction, and wherein the third pressing surface is curved to be recessed in the second direction.

6. The inkjet recording apparatus according to claim 3, wherein the first valve has a pressed surface, wherein, in the attachment process, the second pressing surface contacts and press the pressed surface to move the first valve from the first position to the second position, wherein the second valve has an inner circumferential surface in sliding contact with the outer circumferential surface of the cylinder portion, the inner circumferential surface has one end edge and another end edge in the first direction, the another end edge being positioned further in the first direction than the one end edge, wherein the inlet opening has one end and another end in the first direction, the another end being positioned further in the first direction than the one end, and wherein, at a time when the first pressing surface is brought into contact with the second part of the second valve in the attachment process, a first distance in the first direction between the second pressing surface and the pressed surface is greater than a second distance in the first direction between the one end of the inlet opening and the one end edge of the inner circumferential surface.

7. The inkjet recording apparatus according to claim 3, wherein the cartridge-attachment portion further comprises a slide member fixed to the second valve, the slide member being formed in an annular shape surrounding the outer circumferential surface of the cylinder portion and slidable on the outer circumferential surface, the slide member sliding on the outer circumferential surface together with the second valve when the second valve slides between the third position and the fourth position on the circumferential surface.

8. The inkjet recording apparatus according to claim 1, wherein the cartridge-attachment portion further comprises a passage-partition member disposed in an interior space of the ink supply member, the passage-partition member extending in the first direction from the extending end portion of the cylinder part to partition the interior space into the ink passage and an air passage allowing air to flow therethrough.

* * * * *